US008109598B2

(12) United States Patent
Samoto et al.

(10) Patent No.: US 8,109,598 B2
(45) Date of Patent: Feb. 7, 2012

(54) IMAGE RECORDING DEVICE

(75) Inventors: Kenji Samoto, Nagoya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 431 days.

(21) Appl. No.: 12/415,483

(22) Filed: Mar. 31, 2009

(65) Prior Publication Data

US 2009/0256874 A1 Oct. 15, 2009

(30) Foreign Application Priority Data

Apr. 11, 2008 (JP) ..... 2008-104137

(51) Int. Cl.

| | |
|---|---|
| ***B41J 29/38*** | (2006.01) |
| ***B41J 2/165*** | (2006.01) |
| ***B41J 11/18*** | (2006.01) |
| ***B41J 7/00*** | (2006.01) |

(52) U.S. Cl. ..... 347/32; 347/5; 400/156.2; 400/161.4

(58) Field of Classification Search ..... 347/4–5, 347/9, 20, 32

See application file for complete search history.

(56) References Cited

U.S. PATENT DOCUMENTS

| | | | | |
|---|---|---|---|---|
| 5,841,450 | A | 11/1998 | Kawamura | |
| 7,248,819 | B2 * | 7/2007 | Jeon | 399/159 |
| 7,753,471 | B2 * | 7/2010 | Waller et al. | 347/22 |
| 2007/0048058 | A1 * | 3/2007 | Koga et al. | 400/283 |
| 2007/0048059 | A1 | 3/2007 | Asada et al. | |
| 2007/0057447 | A1 | 3/2007 | Asada et al. | |
| 2007/0076036 | A1 | 4/2007 | Koga et al. | |
| 2007/0231044 | A1 | 10/2007 | Koga et al. | |
| 2009/0035018 | A1 | 2/2009 | Koga | |
| 2009/0035019 | A1 | 2/2009 | Koga | |

FOREIGN PATENT DOCUMENTS

| | | | |
|---|---|---|---|
| JP | H05-024278 | A | 2/1993 |
| JP | H08-174958 | A | 7/1996 |
| JP | 2003-089244 | A | 3/2003 |
| JP | 2007-090761 | A | 4/2007 |
| JP | 2007-090800 | A | 4/2007 |

* cited by examiner

*Primary Examiner* — Jason Uhlenhake
(74) *Attorney, Agent, or Firm* — Baker Botts L.L.P.

(57) ABSTRACT

There is provided an image recording device, comprising first and second motors; first and second switch gears supported coaxially; first and second transmission gears, and wherein the first and second switch gears are provided to engage with corresponding ones of the first and second transmission gears in accordance with movement of the first and second switch gears in an axial direction, and the image recording device further comprises a control unit configured such that when the first switch gear and the second switch gear are moved in the axial direction, the control unit rotates one of the first and second motors by a first predetermined rotation amount, and starts the other of the first and second motors while the one of the first and second motors is rotated. The control unit rotates the other of the first and second motors by a second predetermined rotation amount.

8 Claims, 17 Drawing Sheets

IMAGE RECORDING DEVICE

CROSS-REFERENCE TO RELATED APPLICATION

This application claims priority under 35 U.S.C. §119 from Japanese Patent Application No. 2008-104137, filed on Apr. 11, 2008. The entire subject matter of the application is incorporated herein by reference.

BACKGROUND

1. Technical Field

Aspects of the present invention relate to an image recording device provided with a switch mechanism which switches a driving force between transmission gears connected to drive mechanisms by changing positions of switch gears connected to a motor.

2. Related Art

Conventionally, image recording devices, such as an inkjet printer, have been widely used. The inkjet printer records an image on a recording medium by ejecting ink in accordance with an input signal. More specifically, in the inkjet printer, ink is introduced to actuators in a recording head, and the ink is pressurized and ejected through the effect of deformation of the actuators or the effect of locally boiled ink by heating elements.

The inkjet printer ejects ink selectively from nozzles to form an image on the sheet of paper during a carrying process for carrying the sheet of paper from a paper supply tray to an output tray. The supply of the sheet of paper from the paper supply tray and the carrying of the sheet of paper along a sheet carrying path are performed by providing rollers, such as a supply roller and a carrying roller, to rotate while closely contacting the sheet of paper. In general, a motor, such as a DC motor or a stepping motor, is used as a driving source, and transmission of the driving force from the motor to the rollers is achieved through a transmission mechanism, such as a pinion gear or a timing belt.

There is a possibility that a faulty ejection condition occurs in the ejecting motion of the nozzles, for example, due to air bubbles caused in the nozzles or foreign material lodging in the nozzles. To prevent such a faulty ejection condition, a purge motion is executed in the printer. A maintenance unit for executing the purge motion includes a cap for covering the nozzles of the recording head, and a pump to depressurize the inside of the cap. The motor is also used for driving the pump and a cam for switching the status of an exhaust valve, and the above described transmission mechanism is used for transmitting the drive force from the motor to driving units.

Japanese Patent Provisional Publication No. 2007-90761 (hereafter, referred to as JP2007-90761A) discloses an image recording device provided with a driving force transmission switch unit for switching the driving force from a motor to driving units. The driving force transmission switch unit is configured to selectively transmit the driving force to the driving units. By this structure, it becomes possible to transmit the driving force from a single motor to a supply roller or a carrying roller during image formation, and to transmit the driving force to a maintenance unit during the purge operation.

More specifically, the image recording device disclosed JP2007-90761A is configured as follows. In the following, reference numbers in parentheses correspond to those indicated in JP2007-90761A. In the image recording device disclosed JP2007-90761A, a driving force from a single LF motor (42) is transmitted to a plurality of driving units through the driving force transmission switch unit (100). The driving force transmission switch unit (100) includes a single switch gear (102) and four types of transmission gears including an intermittent supply transmission gear (113), a continuous supply transmission gear (114), a lower stage supply transmission gear (121) and a maintenance transmission gear (115). By positioning a lever part (104*a*) to one of setting portions 111, 112 and 108, the switch gear (102) engages with corresponding one of the transmission gears to transmit the driving force. The position of the lever part (104*a*) is set by movement of a carriage (13) in a main scanning direction in accordance with an operation mode.

Japanese Patent Provisional Publication No. HEI 8-174958 (hereafter, referred to as JP HEI 8-174958A) discloses an image recording device configured to have a switch gear, a transmission gear connected to a carrying driving unit, and a transmission gear connected to a purge driving unit. More specifically, in order to smoothly switch the switch gear between the transmission gear connected to the carrying driving unit and the transmission gear connected to the carrying driving unit, the motor is controlled to reciprocate and the switch gear is controlled to reciprocate in the same direction. By this structure, the switch gear is smoothly detached from one of the transmission gear and is smoothly engaged with another transmission gear.

SUMMARY

Among various types of image recording devices such as an inkjet printer, an image recording deice provided with a plurality of paper supply trays for convenience of uses are also widely used. In such an image recording device, the user is allowed to set a large amount of sheets of paper in one paper supply tray and to set another type of paper having a desired size in the other paper supply tray. In the image recording device provided with the plurality of paper supply trays, a plurality of supply rollers respectively corresponding to the plurality of paper supply trays are provided.

Image recording devices are provided with multiple functions particularly in recent years. Therefore, various types of driving units are provided for an image recoding device. If a plurality of driving units are provided in the image recoding device, a structure of a transmission mechanism for transmitting a driving force from a single motor to the plurality of driving units becomes inevitably complicated. Furthermore, the sequence of switch timing between the driving units becomes complicated. This might cause a problem that a time for switching a transmission gear to another desired transmission gear becomes too long.

If a plurality of motors are used, it is possible to form the transmission mechanism in a relatively simple structure. For example, the transmission mechanism may be configured such that a first switch gear connected to a first motor is positioned to be able to selectively engage with transmission gears of respective supply rollers, and that a second switch gear connected to a second motor is positioned to be able to selectively engage with transmission gears of carrying rollers and a pump of a maintenance unit. However, the switch gears and the transmission gears are not always located at positions where the switch gears are able to engage with respective transmission gears. For this reason, even if the switch gears are moved concurrently in a moving direction, each switch gear might not be able to properly engage with the transmission gear.

Furthermore, due to a surface pressure between gears provided between the driving unit and the transmission gear, the switch gear might become unable to move in the axial direction, and thereby the switch gear and the transmission gear might become unable to engage with each other. In these cases, the switch gear and the transmission gear may become able to engage with each other by controlling each motor to reciprocate as described in JP HEI 8-174958A.

However, if the plurality of motors are controlled to reciprocate in a careless way, each switch gear can not be switched between the transmission gears. For example, if a pair of gears are brought to a state of being able to engage with each other, the other pair of gears might become unable to engage with each other due to excessively increased rotation speed of the motor. Furthermore, even if the plurality of motors are alternatively driven in the state where switch gears engage with respective transmission gears, both of the switch gears are not able to move concurrently due to the surface pressure when one of the switch gears is stopped. In this case, each switch gear becomes unable to engage with the transmission gear.

Aspects of the present invention are advantageous in that an image recording device capable of engaging a plurality of switch gears with transmission gears quickly and reliably is provided.

According to an aspect of the invention, there is provided an image recording device, comprising: a first motor configured to be able to rotate in a first rotational direction and a second rotational direction different from the first rotational direction; a second motor configured to be able to rotate in the first rotational direction and the second rotational direction; a first switch gear that is rotated by receiving a driving force from the first motor; a second switch gear that is rotated by receiving a driving force from the second motor and is supported coaxially with respect to the first switch gear; a first transmission gear that is located to be able to engage with the first switch gear and transmits a driving force to a first driving unit; and a second transmission gear that is located to be able to engage with the second switch gear and transmits a driving force to a second driving unit. The first switch gear and the second switch gear are provided to engage with corresponding ones of the first transmission gear and the second transmission gear in accordance with movement of the first and second switch gears in an axial direction. The image recording device further comprises a control unit configured such that when the first switch gear and the second switch gear are moved in the axial direction, the control unit rotates one of the first and second motors by a first predetermined rotation amount, and starts the other of the first and second motors while the one of the first and second motors is rotated. The control unit rotates the other of the first and second motors by a second predetermined rotation amount.

In the above described configuration, an overlapping drive period in which the first and the second motors are driven concurrently can be secure. Therefore, it is possible to release a surface pressure acting on gears and, for at least one of the motors, it is possible to move the switch gear and the transmission gear to the state of being able to engage with each other at a low speed period of the corresponding motor (i.e., a state immediately after activation of the motor). Consequently, it becomes possible to engage each switch gear to a corresponding transmission gear rapidly and securely before the speed of each motor increases.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

Figure 5:
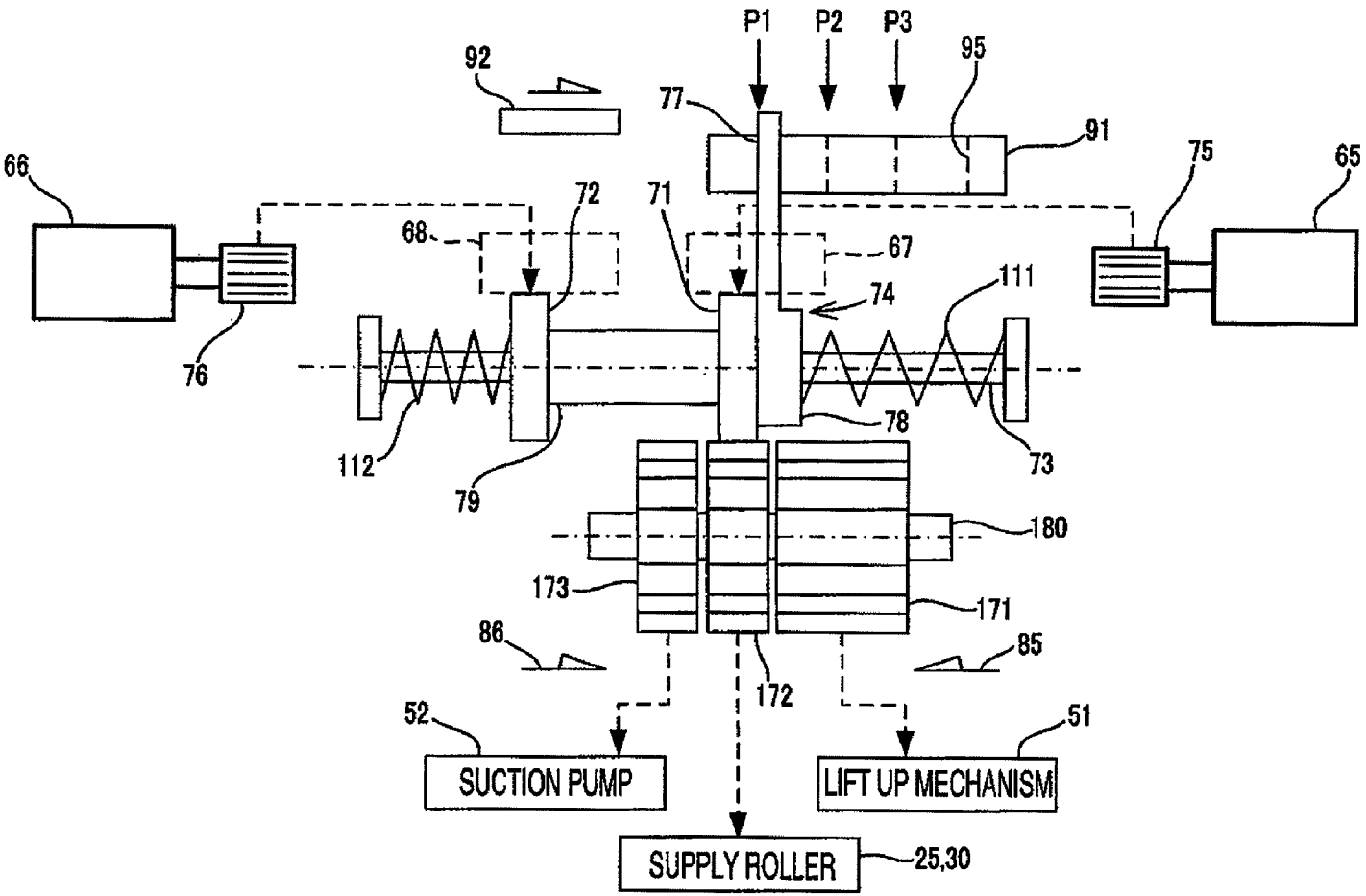

FIG. 5 schematically illustrates a structure of a gear unit and a transmission path.

Figure 6A:
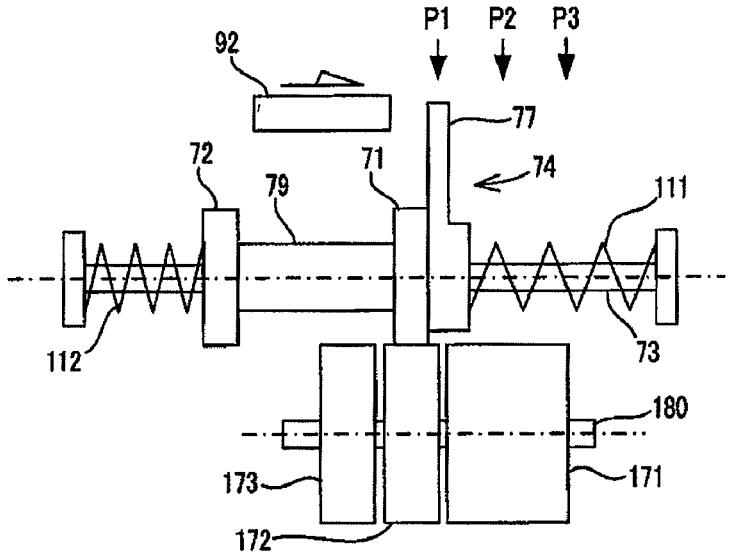
Figure 6B:
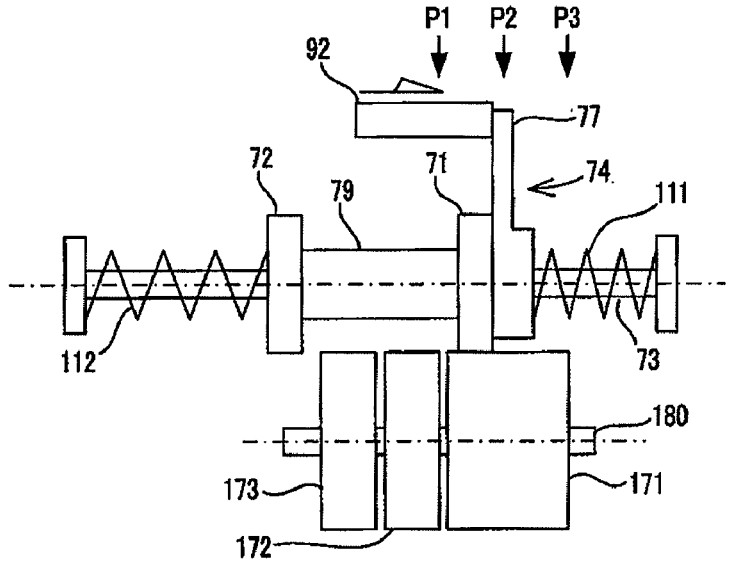
Figure 6C:
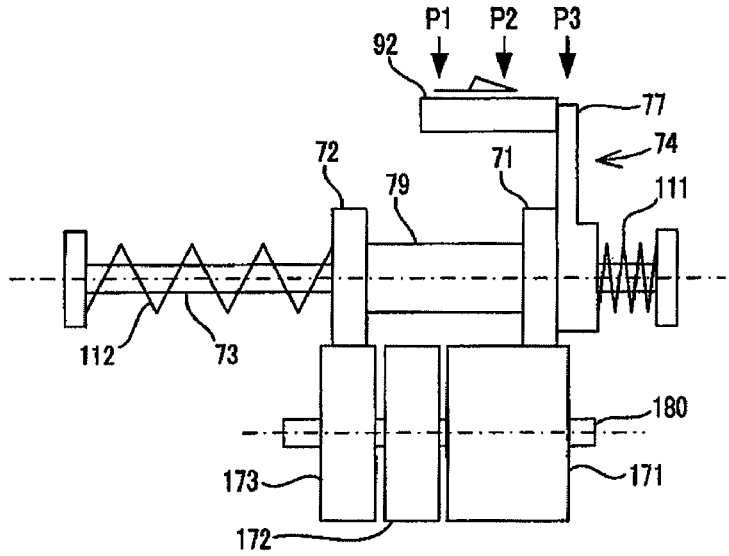

FIGS. 6A to 6C are explanatory illustrations for explaining positions of an input lever and motion of the gear unit.

Figure 7A:
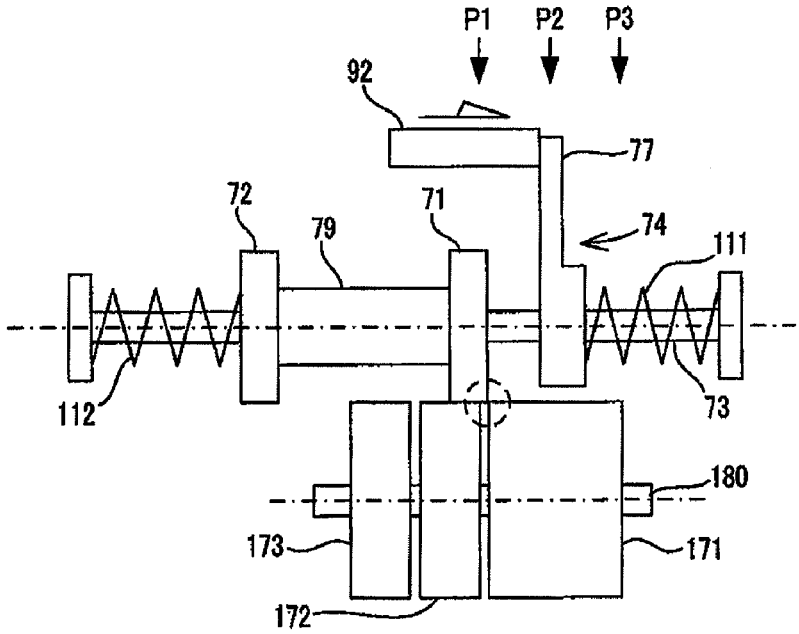
Figure 7B:
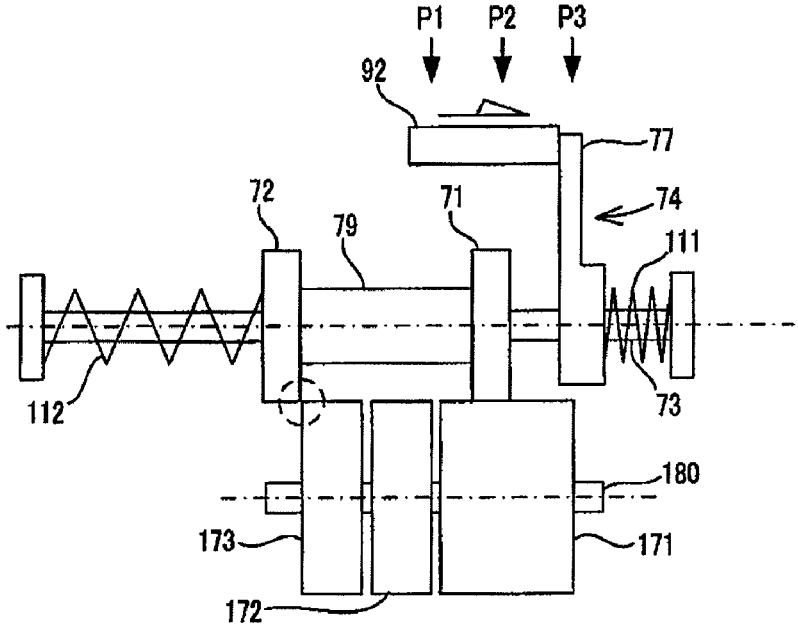

FIGS. 7A and 7B are explanatory illustrations for explaining malfunctions of the gear unit.

Figure 8:
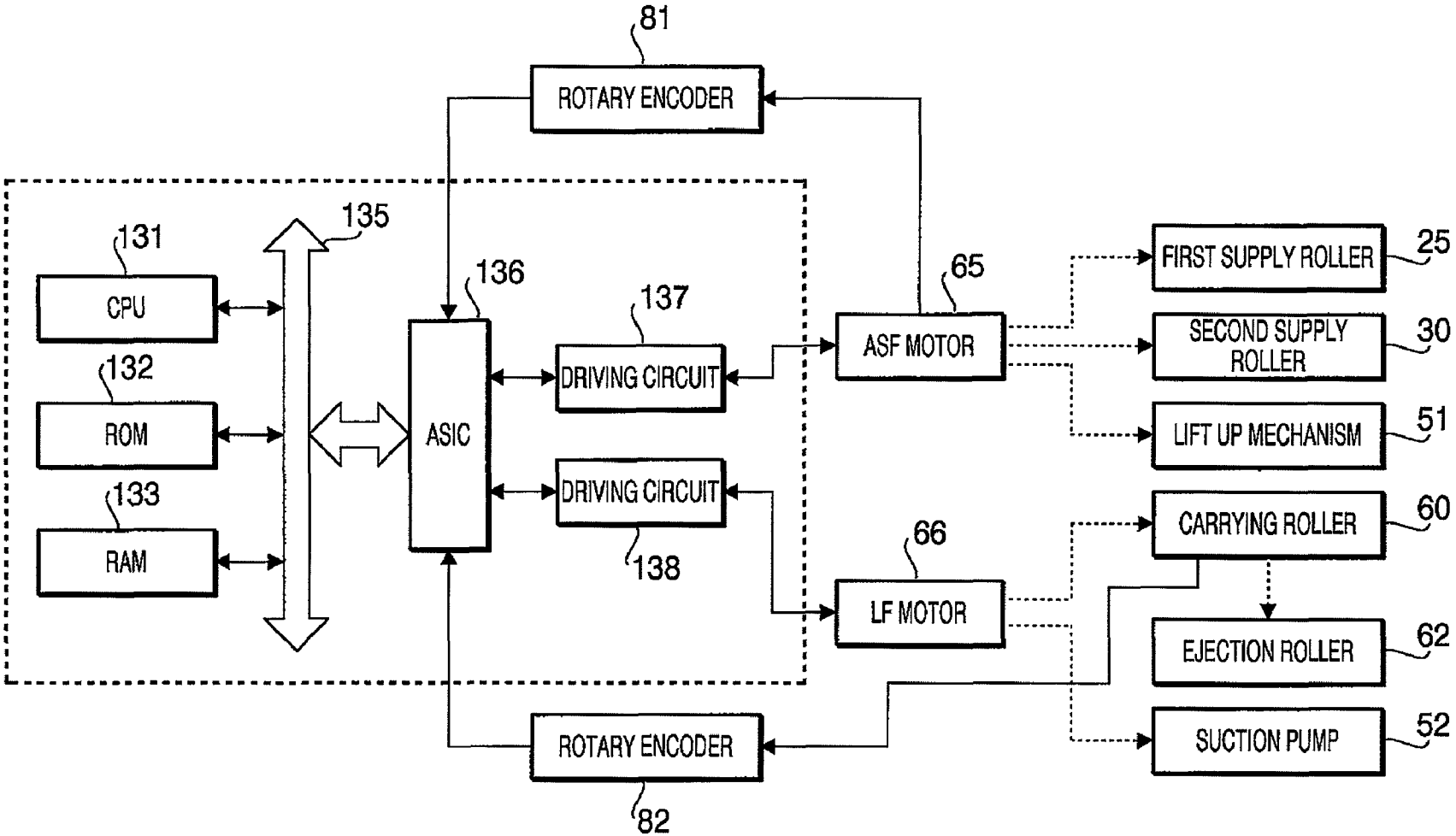

FIG. 8 is a block diagram of a motor control unit.

Figure 9:
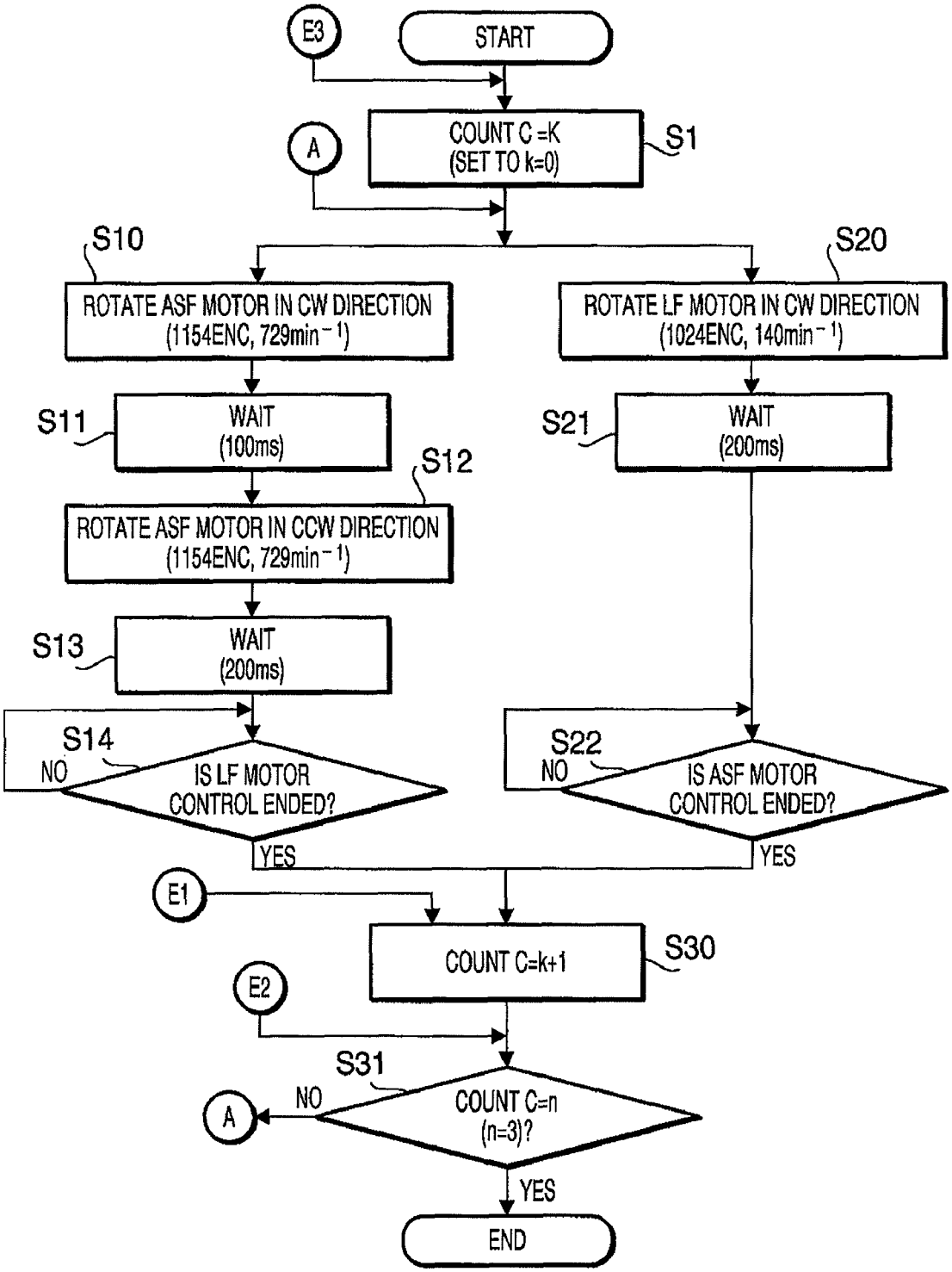

FIG. 9 is a flowchart illustrating a motor control process executed by the motor control unit.

Figure 10:
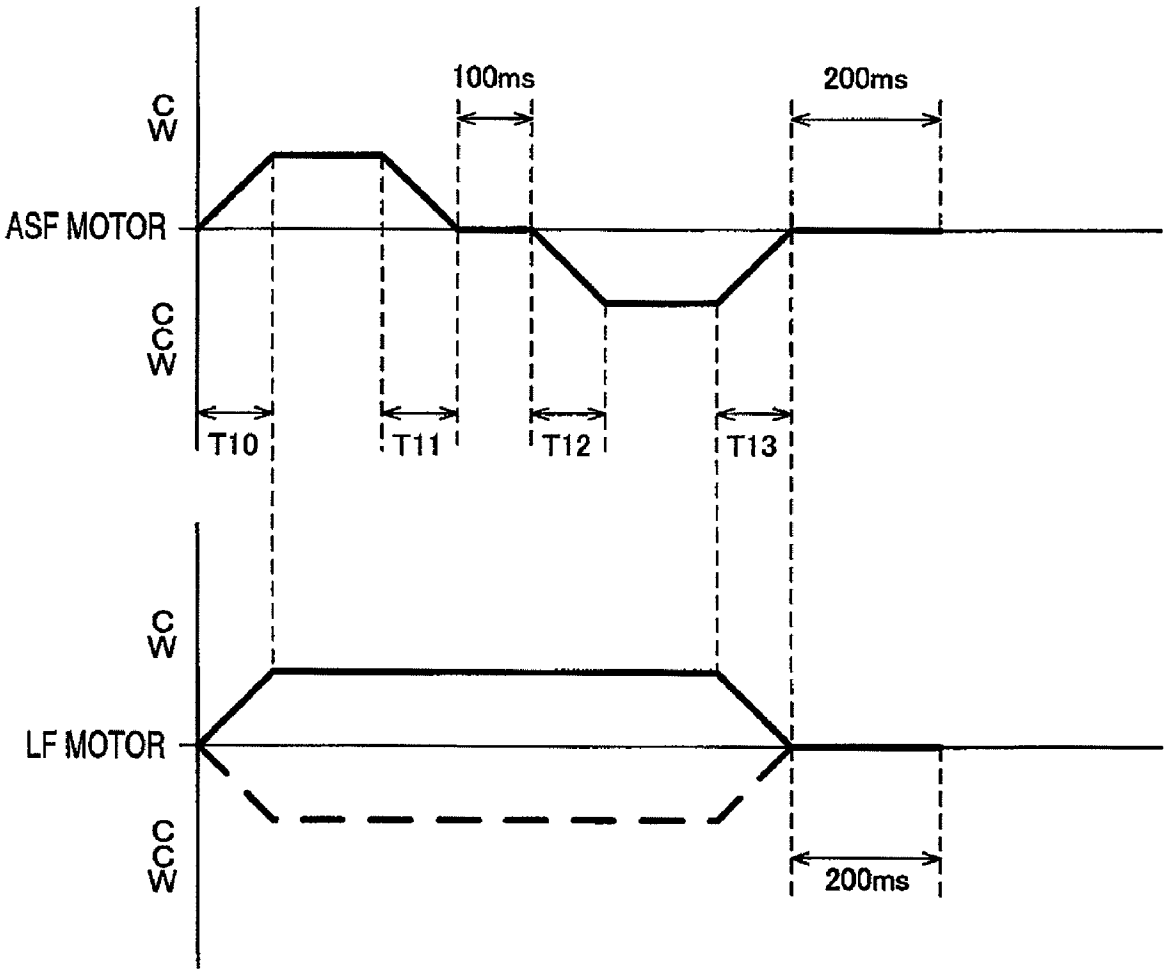

FIG. 10 is a timing chart illustrating an operation state of an ASF motor and an LF motor.

Figure 11:
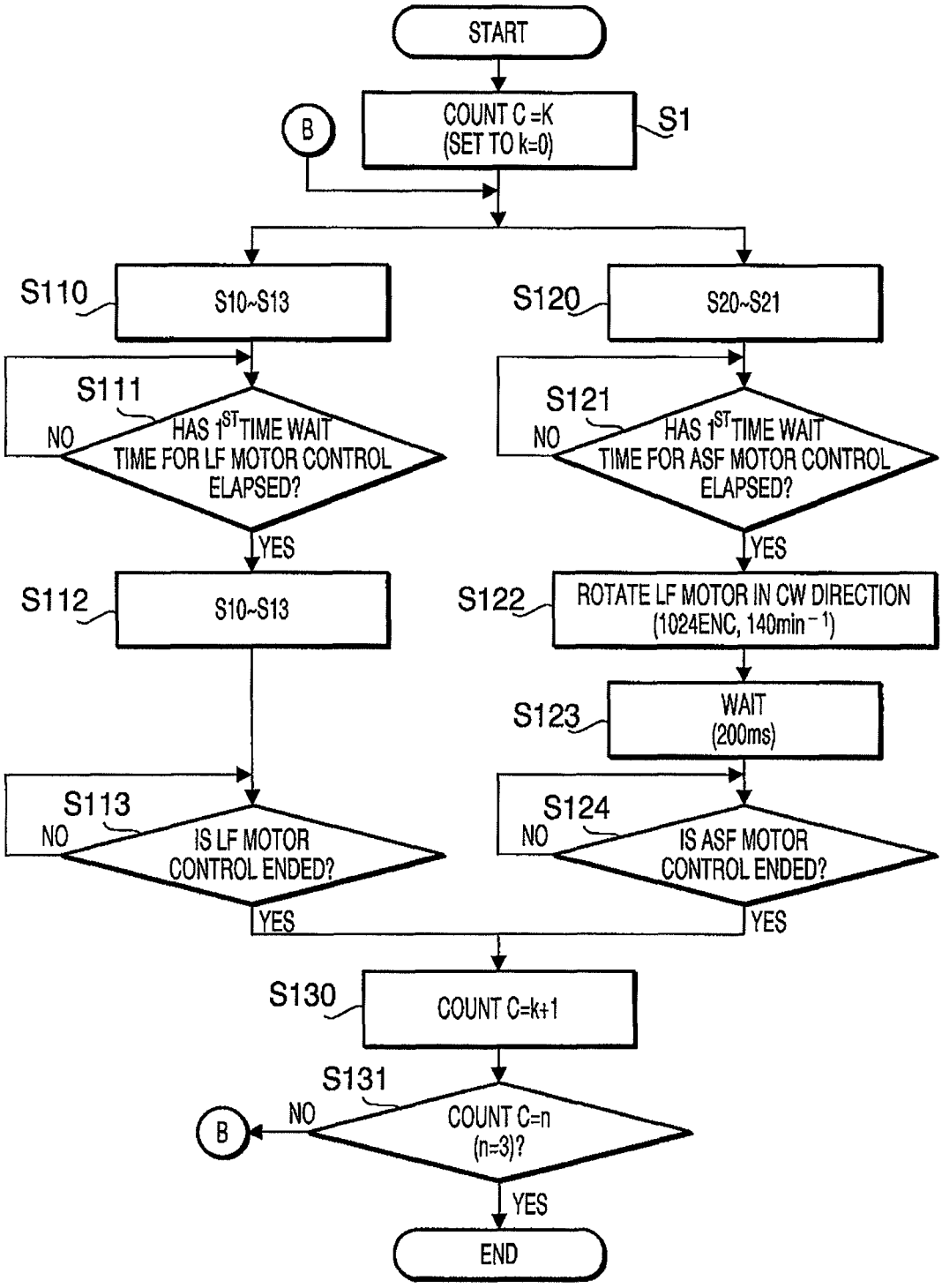

FIG. 11 is a flowchart illustrating a first variation of the motor control process executed by the motor control unit.

Figure 12:
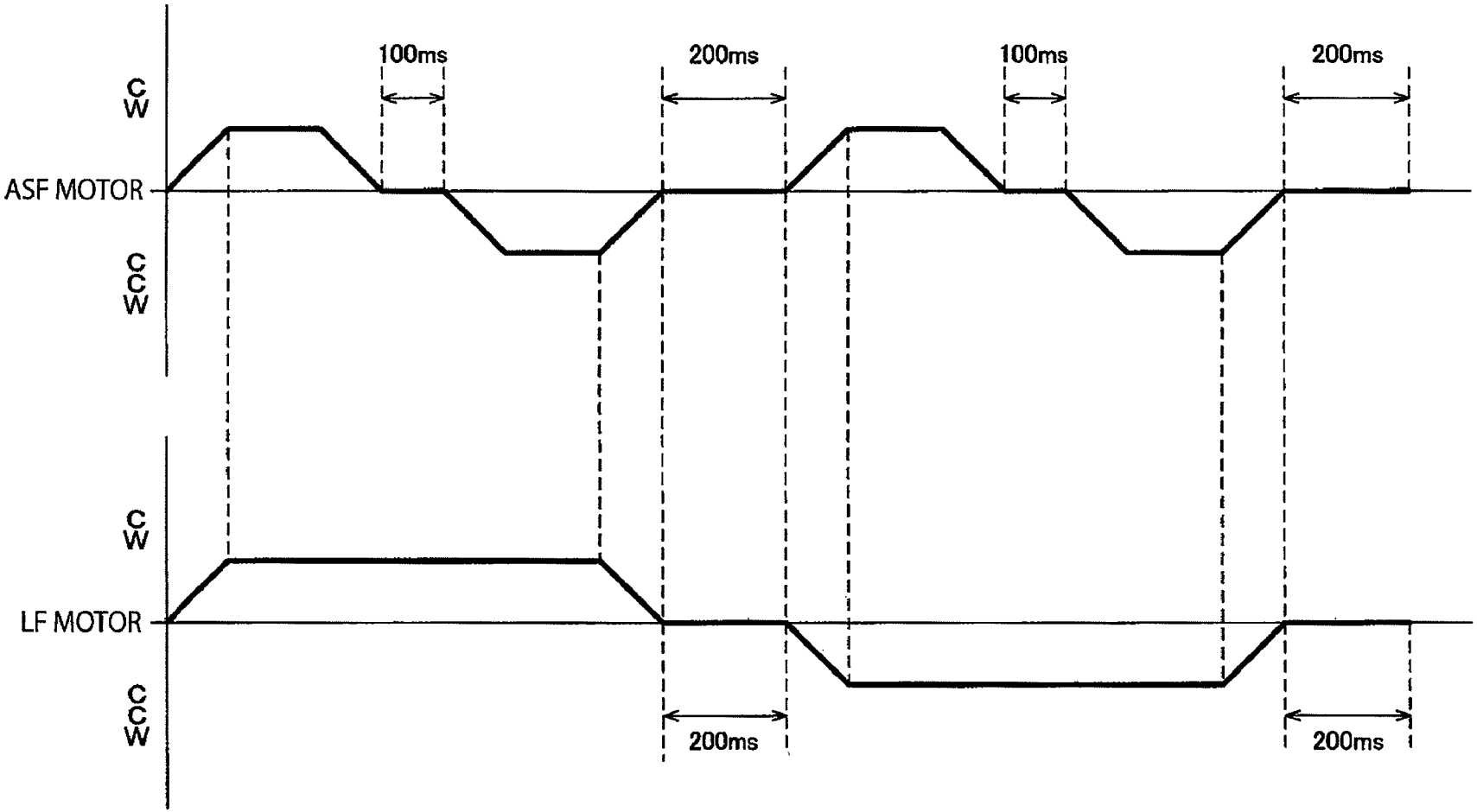

FIG. 12 is a timing chart illustrating an operation state of the ASF motor and the LF motor during the motor control process shown in FIG. 11.

Figure 13:
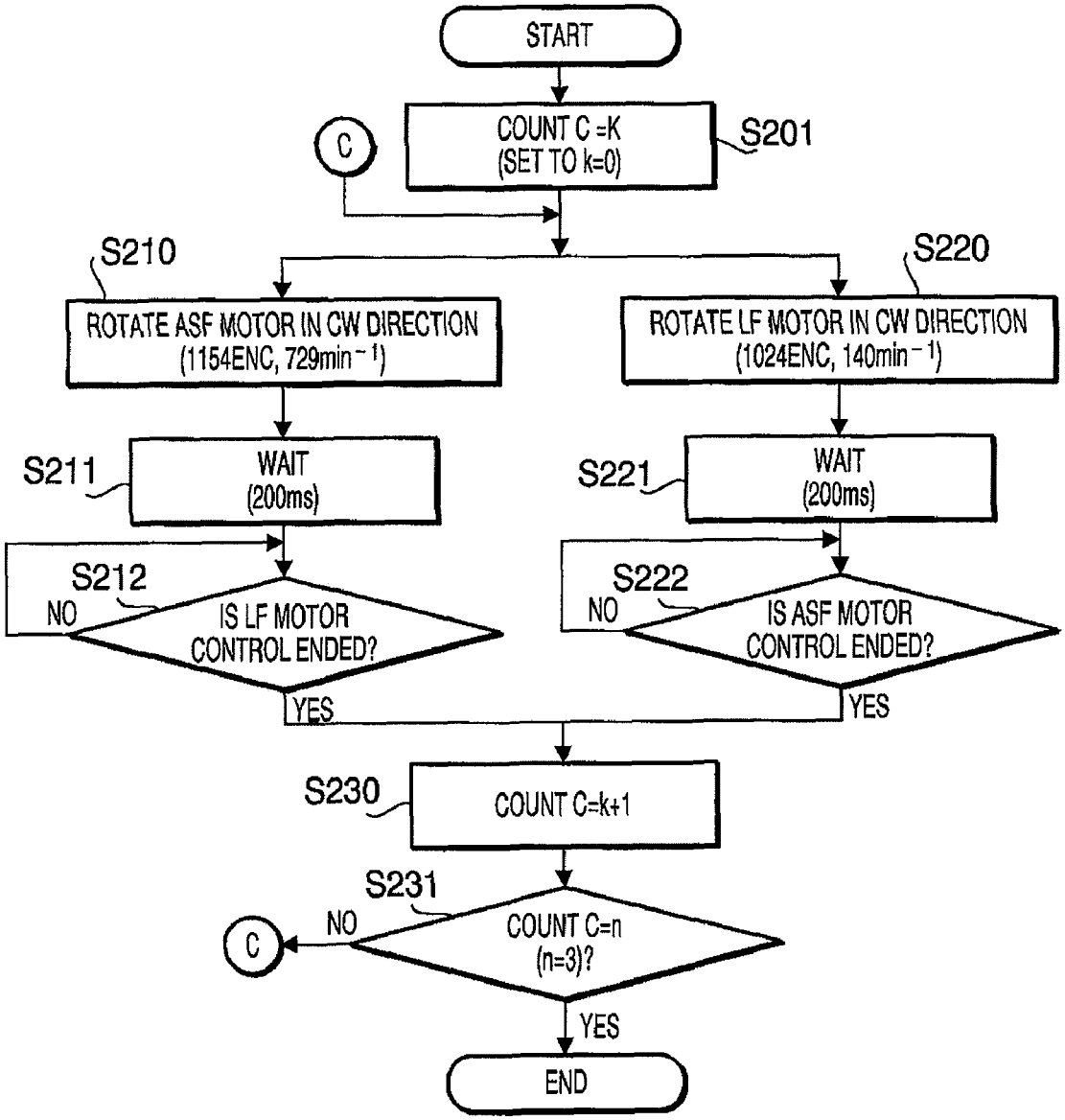

FIG. 13 is a flowchart illustrating a second variation of the motor control process executed by the motor control unit.

Figure 14:
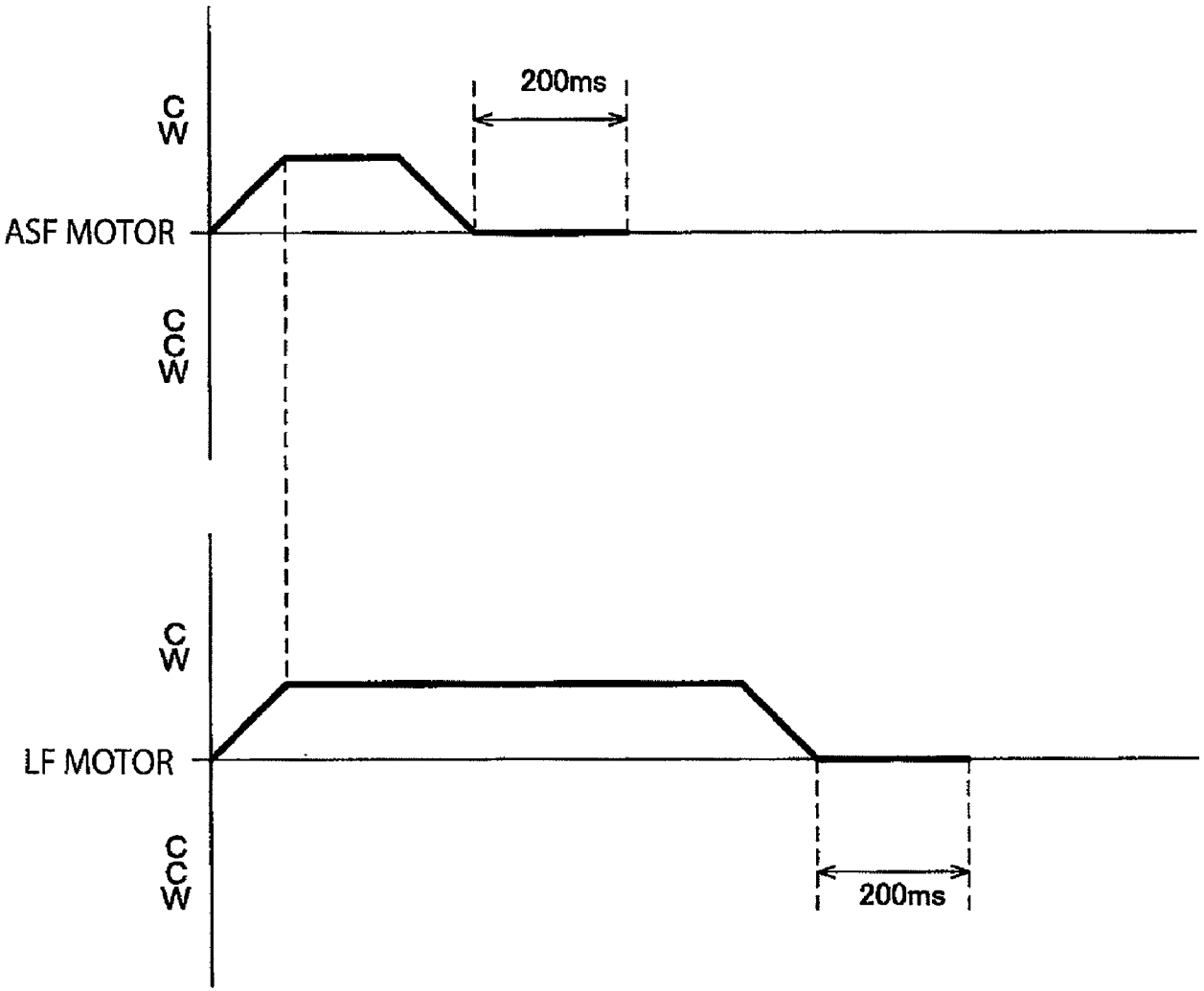

FIG. 14 is a timing chart illustrating an operation state of the ASF motor and the LF motor during the motor control process shown in FIG. 13.

Figure 15:
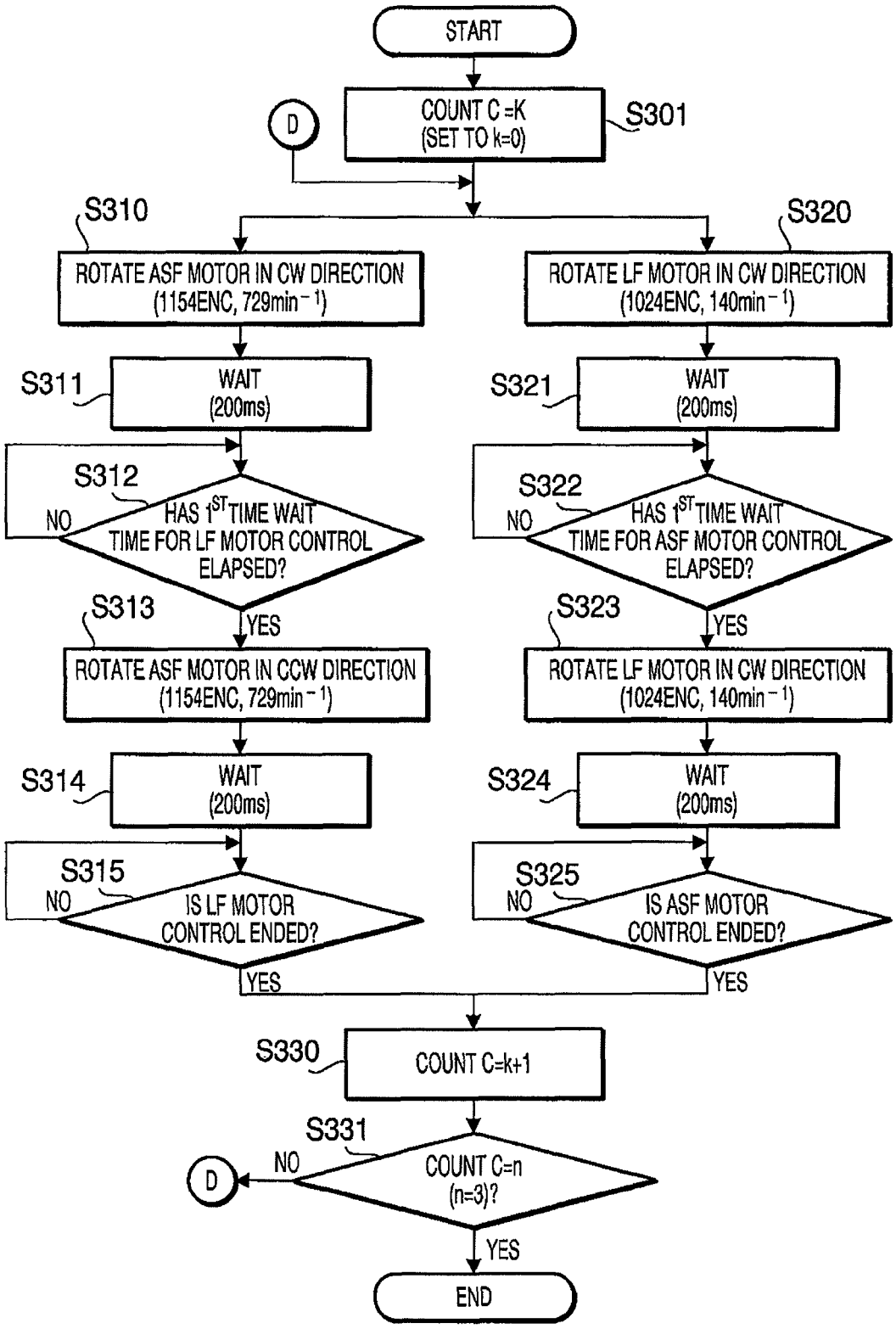

FIG. 15 is a flowchart illustrating a third variation of the motor control process executed by the motor control unit.

Figure 16:
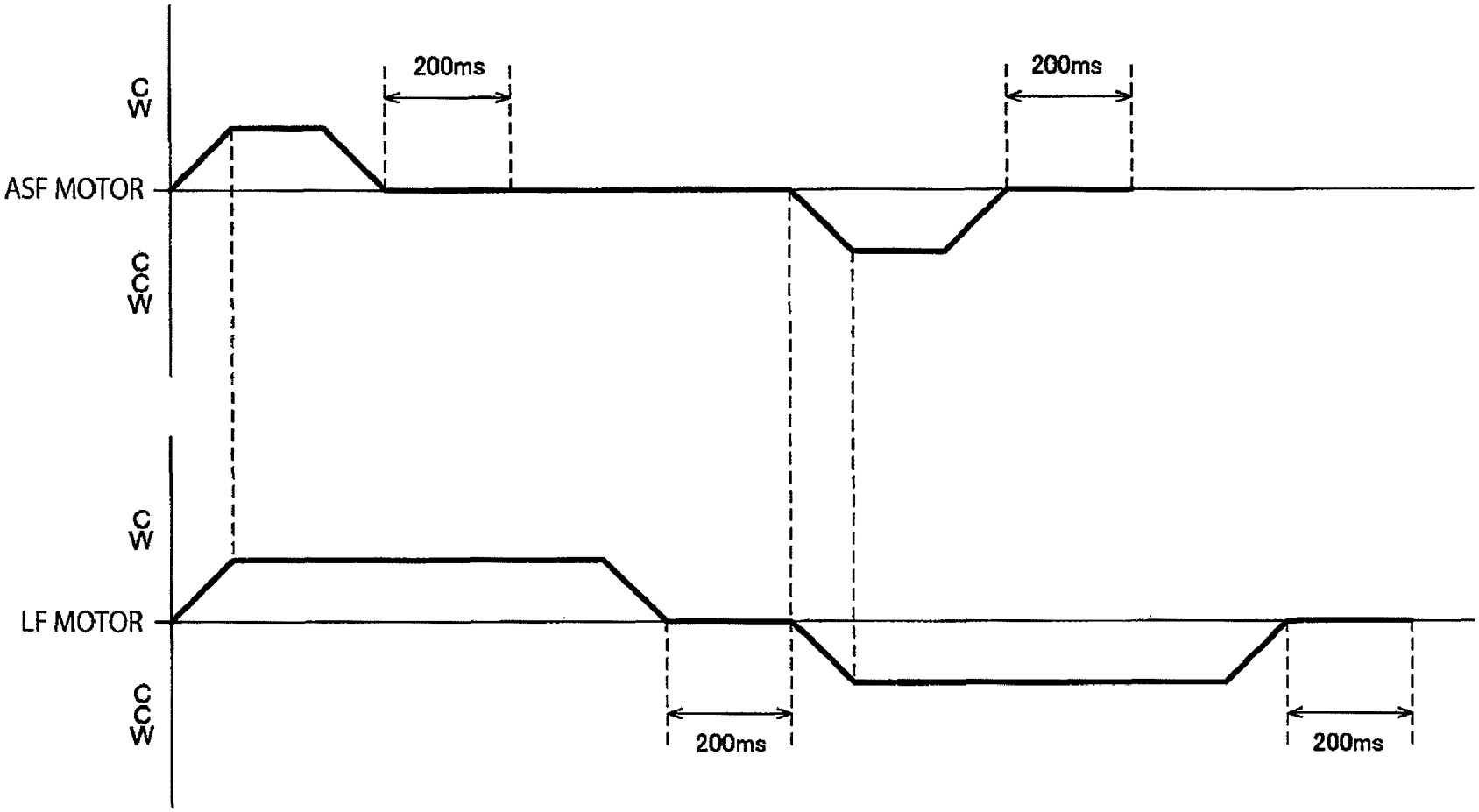

FIG. 16 is a timing chart illustrating an operation state of the ASF motor and the LF motor during the motor control process shown in FIG. 15.

Figure 17A:
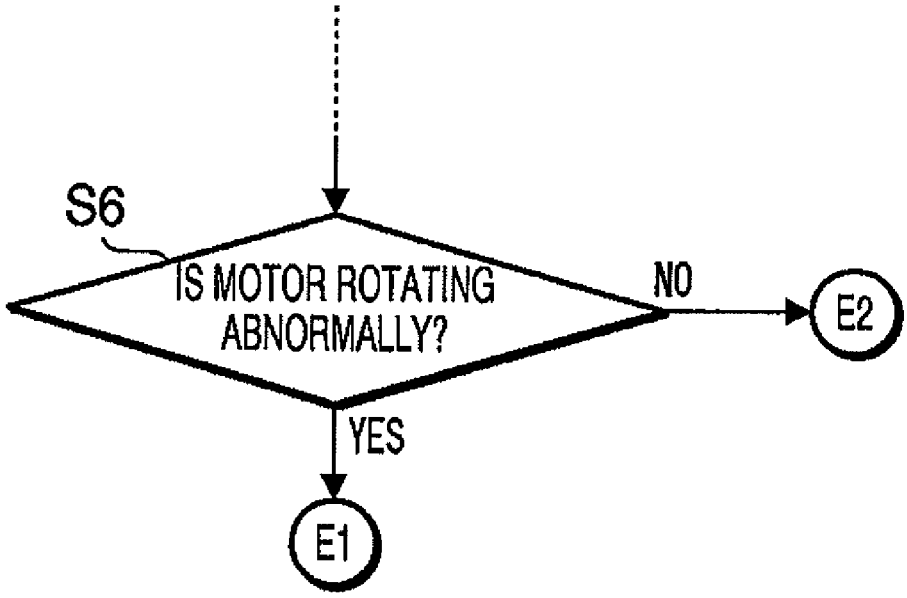
Figure 17B:
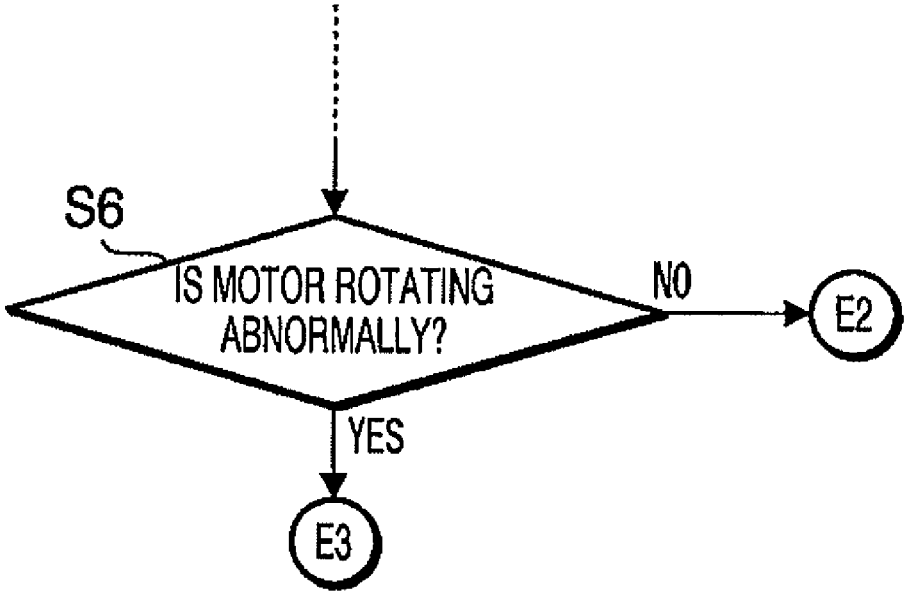

FIGS. 17A and 17B are flowcharts illustrating a fourth variation of the motor control process executed by the motor control unit.

DETAILED DESCRIPTION

Hereafter, an embodiment according to the invention will be described with reference to the accompanying drawings.

Figure 1:
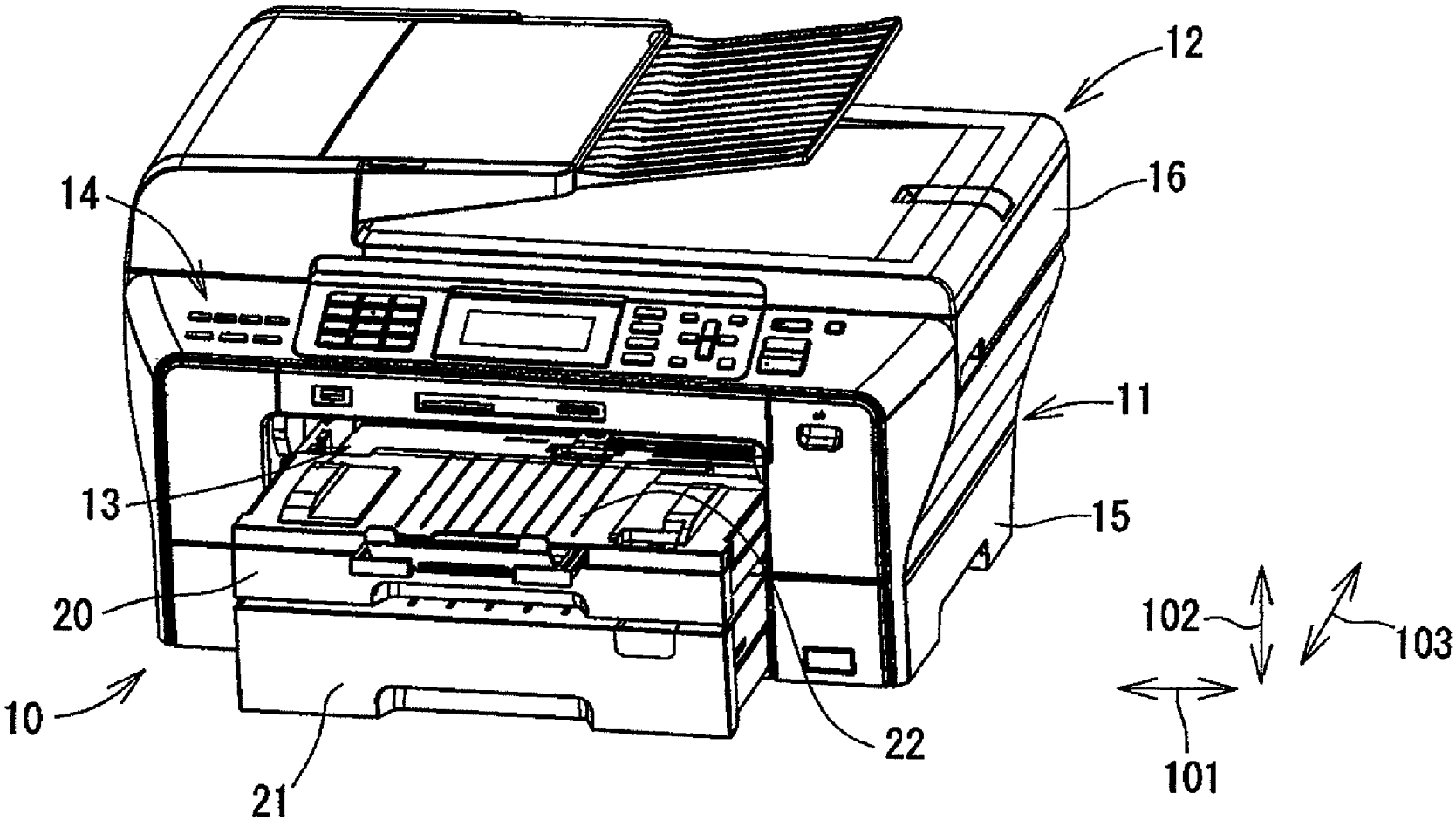
FIG. 1 is a perspective view illustrating an outer appearance of an MFP (Multifunction Peripheral) according to an embodiment.
Figure 2:
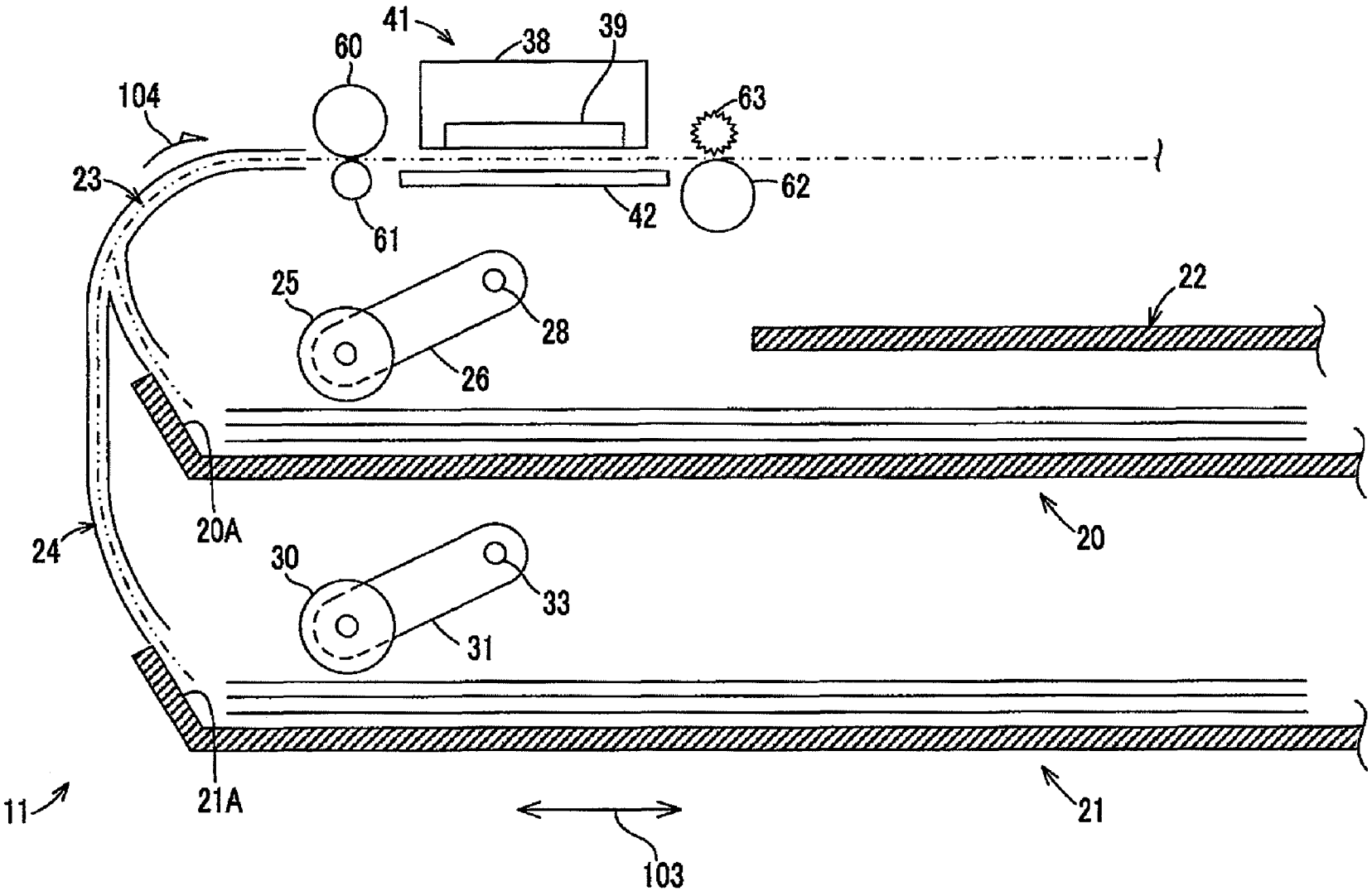
FIG. 2 is a cross sectional view illustrating an internal structure of a print unit provided in the MFP.
Figure 3:
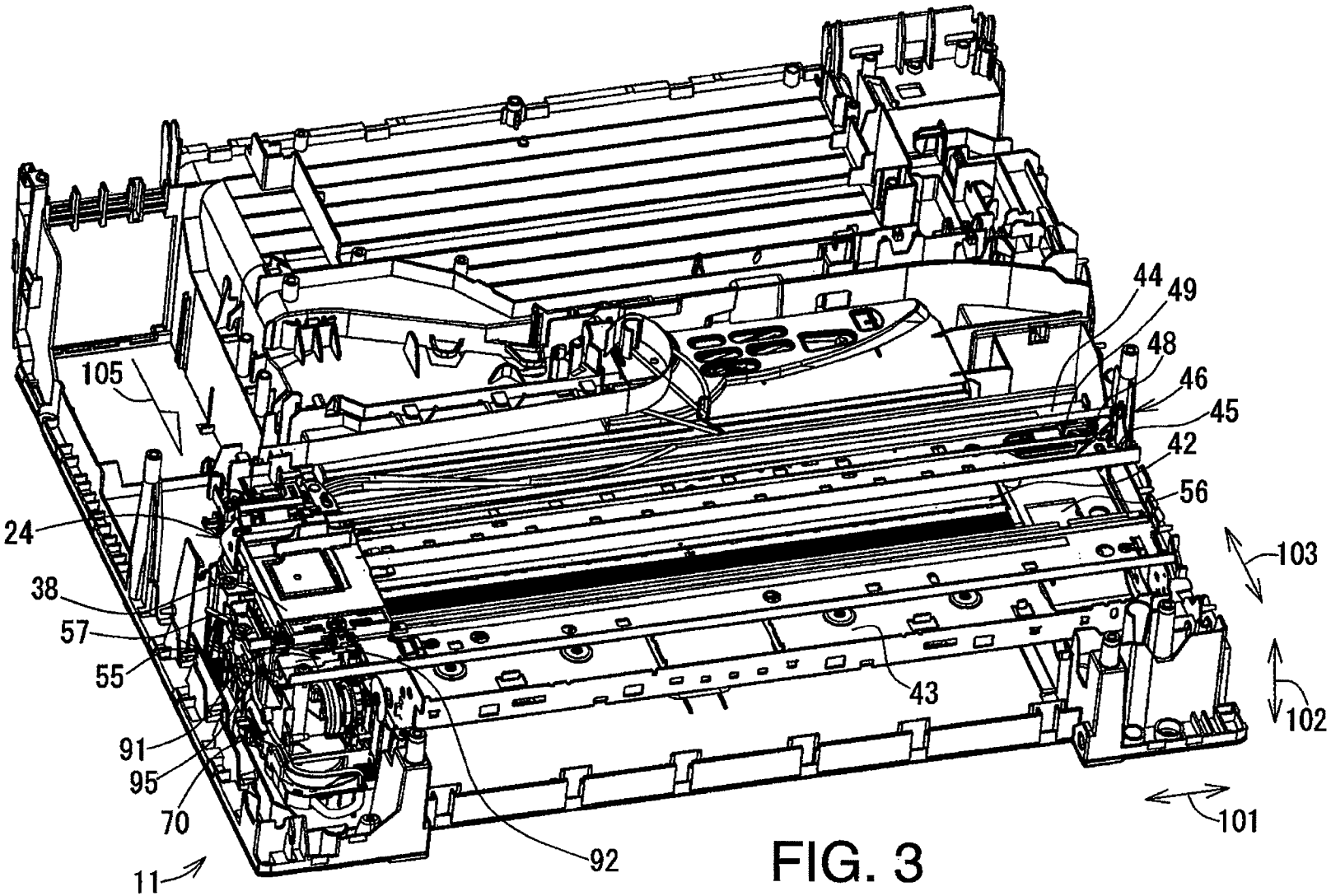
FIG. 3 is a perspective view of the internal structure of the print unit when viewed from the rear side.

FIG. 1 is a perspective view illustrating an outer appearance of an MFP (Multifunction Peripheral) 10 according to an embodiment. FIG. 2 is a cross sectional view illustrating an internal structure of a print unit 11 provided in the MFP 10. FIG. 3 is a perspective view of the internal structure of the print unit 11 when viewed from the rear side.

Figure 4:
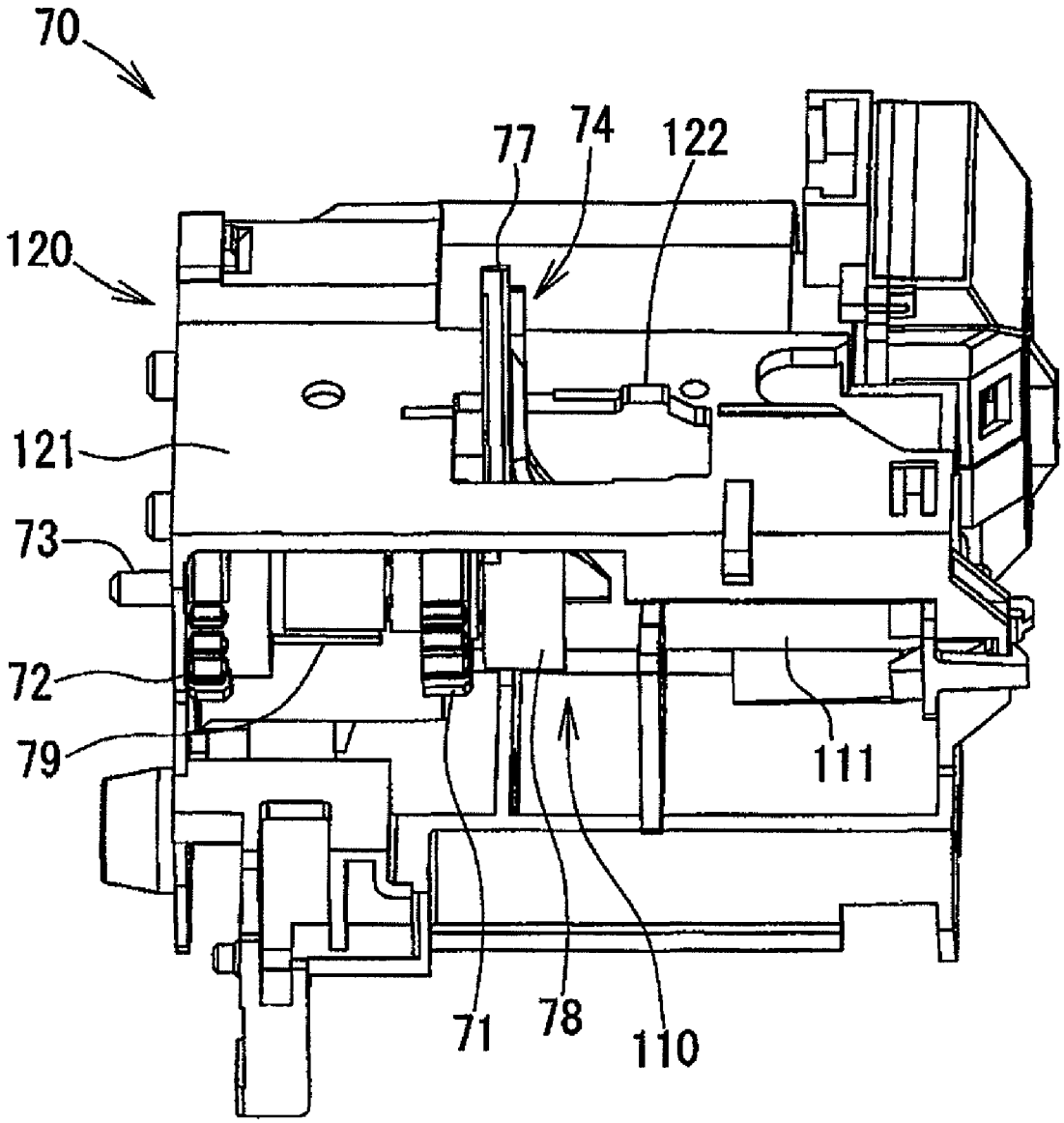
FIG. 4 is a perspective view illustrating a drive switch mechanism provided in the MFP.

FIG. 4 is a perspective view illustrating a drive switch mechanism 70. FIG. 5 schematically illustrates a structure of a gear unit 110 and a transmission path. FIGS. 6A to 6C are explanatory illustrations for explaining positions of an input lever 74 and motion of the gear unit 110. FIGS. 7A and 7B are explanatory illustrations for explaining malfunctions of the gear unit 110.

FIG. 8 is a block diagram of a motor control unit 130. FIG. 9 is a flowchart illustrating a motor control process executed by the motor control unit 130. FIG. 10 is a timing chart illustrating an operation state of an ASF motor 65 and an LF motor 66.

FIG. 11 is a flowchart illustrating a first variation of the motor control process executed by the motor control unit 130. FIG. 12 is a timing chart illustrating an operation state of the ASF motor 65 and the LF motor 66 during the motor control process shown in FIG. 11.

FIG. 13 is a flowchart illustrating a second variation of the motor control process executed by the motor control unit 130. FIG. 14 is a timing chart illustrating an operation state of the ASF motor 65 and the LF motor 66 during the motor control process shown in FIG. 13.

FIG. 15 is a flowchart illustrating a third variation of the motor control process executed by the motor control unit 130. FIG. 16 is a timing chart illustrating an operation state of the ASF motor 65 and the LF motor 66 during the motor control process shown in FIG. 15.

FIGS. 17A and 17B are flowcharts illustrating a fourth variation of the motor control process executed by the motor control unit 130.

As shown in FIGS. 1 and 2, the MFP 10 includes the print unit 11 and a scanner unit 12 which are integrally formed. The MFP 10 has a print function, a scanner function, a copying function, and a facsimile function. The MFP 10 may be configured not to have the scanner function, the copying function and the facsimile function. For example, if the MFP 10 is configured not to have the scanner unit 12, the MFP 10 is formed as a single-function device having only the print function.

In the MFP 10, the print unit 11 is located on the lower side and the scanner unit 12 is located on the upper side. The print unit 11 records an image (including text) on a sheet of recording medium (e.g., a sheet of paper) in accordance with print data (including image data and text data) transmitted from an external computer. In this embodiment, the scanner unit 12 is formed as a flat bed scanner.

As shown in FIG. 1, the MFP 10 has a box shape whose width (indicated by an arrow 101) and the depth (indicated by an arrow 103) are larger than the height (indicated by an arrow 102). That is, the MFP 10 has a low-profile box shape. The outer shape of the MFP 10 is formed principally by a casing 15 of the printer unit 11 and a casing 16 of the scanner unit 16.

The casing 15 of the printer unit 11 has an opening 13 on the front side. In the inside of the opening 13, a first paper supply cassette 20 and a second paper supply cassette 21 are provided. The first and second paper supply cassettes 20 and 21 are mounted in a two layer structure in a vertical direction such that the first paper supply cassette 20 is located on the upper side and the second paper supply cassette 21 is located on the lower side. A top surface 22 of the first paper supply cassette 21 serves as an output tray. In this configuration, a sheet of paper supplied from the first paper supply cassette 21 or the second paper supply cassette 21 is subjected to an image formation process, and thereafter is ejected to the top surface 22 of the first paper supply cassette 20.

On the upper front portion of the casing 15 of the print unit 11, an operation panel 14 is provided. Through the operation panel 14, a user is able to input various commands such as a command for controlling the print unit 11 or the scanner unit 12 to execute a desired operation. On the operation panel 14, various types of buttons for user operations and a display for displaying various types of information including error information are provided. When the MFP 10 is connected to an external device, the MFP 10 is also able to operate in accordance with commands transmitted from the external device via communication software, such as a printer driver or a scanner driver.

As shown in FIG. 2, the print unit 11 is provided with the first and second paper supply cassettes 20 and 21. The second paper supply cassette 21 is located at the bottom of the print unit 11. The first paper supply cassette 20 is located on the upper side of the second paper supply cassette 21. Each of the first and second paper supply cassettes 20 and 21 is connected to the top surface 22 of the first paper supply cassette 20 via a first paper carrying path 23 and a second paper carrying path 24. The sheets of paper accommodated in the first paper supply cassette 20 are supplied one by one by a first supply roller 25. The sheet of paper supplied from the first paper supply cassette 20 is guided, from the lower side to the upper side, through the first paper carrying path 23 in a form of a horizontally-oriented letter U, toward an image recordation unit 41. After the image formation is executed on the sheet of paper at the image recordation unit 41, the sheet of paper is ejected to the top surface 22 of the first paper supply cassette 20.

The sheets of paper accommodated in the second paper supply cassette 21 are supplied one by one by a second supply roller 30. The sheet of paper supplied from the second paper supply cassette 21 is guided, from the lower side to the upper side, through the second paper carrying path 24 in a form of a horizontally-oriented letter U, toward the image recordation unit 41. After the image formation is executed on the sheet of paper at the image recordation unit 41, the sheet of paper is ejected to the top surface 22 of the first paper supply cassette 20.

The first paper supply cassette 20 is configured such that a rear part of a case thereof is opened (i.e., a rear side opening is formed) and a stack of sheets is accommodated in the inside thereof. In this embodiment, the first supply roller 25 contacts the top of the stacked sheets while being inserted into the inside of the first paper supply cassette 20 through the rear side opening. The first paper supply cassette 20 is able to accommodate various types of sheets of paper smaller than or equal to A3 size paper, such as A4 size, B5 size, and post card size. The top surface 22 of the first paper supply cassette 20 serving as an output tray on which the sheet of paper is ejected is located on the front side of the MFP 10.

The second paper supply cassette 21 is configured such that a rear part of a case thereof is opened (i.e., a rear side opening is formed) and a stack of sheets is accommodated in the inside thereof. In this embodiment, the second supply roller 30 contacts the top of the stacked sheets while being inserted into the inside of the second paper supply cassette 21 through the rear side opening. The second paper supply cassette 21 is able to accommodate various types of sheets of paper smaller than or equal to A3 size paper, such as A4 size, B5 size, and post card size.

If an image recording device is configured to have a single paper supply cassette, in order to form an image on a sheet of paper having a size different from the size of a sheet of paper being accommodated in a paper supply cassette, the user is required to replace the sheet of paper accommodated in the cassette with a new sheet of paper having the different size. By contrast, since the MFP 10 according to the embodiment has two paper supply cassettes, the user is allowed to set sheets of paper having a certain size in one of the first and second paper supply cassettes 20 and 21 and sets sheets of paper having a different size in the other of the first and second paper supply cassettes 20 and 21. Therefore, according to the embodiment, the above described problem can be solved. That is, the user is able to execute the image formation selectively on one of two types of sheets of paper without conducting troublesome work for replacing sheets of paper in a cassette with new sheets of paper.

The first supply roller 25 is located on the rear side of the first paper supply cassette 20 (i.e., on the left side on FIG. 2). The first supply roller 25 feeds the sheet of paper stacked on the first paper supply cassette 20 to the first paper carrying path 23. The first supply roller 25 is rotated while being applied a driving force in a clockwise (CW) direction from an ASF (Auto Sheet Feed) motor 65 provided in the print unit 11 (see FIG. 5) via a gear transmission mechanism (not shown). The first supply roller 25 is pivotally supported at a tip of a first arm 26. A proximal end of the first arm 26 is pivotally attached to a driving shaft 28 installed on the upper side of the first paper supply cassette 20. Therefore, the first supply roller 25 is able to move in a vertical direction to contact or detach from the first paper supply cassette 20.

The first arm 26 is rotated downward through its own weight or a spring (not shown) so that the first arm 26 is able to move upward or downward depending on the amount of the staked sheets of paper accommodated in the first paper supply cassette 20. Consequently, the first supply roller 25 contacts the top of the sheets of paper stacked on the first paper supply cassette 20. When the first supply roller 25 is rotated in this state, at least a sheet of paper on the top of the stacked sheets is supplied toward the first paper carrying path 23 due to friction between a surface of the first supply roller 25 and the sheet of paper. Even if a plurality of sheets of paper are supplied by the first supply roller 25 toward the first paper carrying path 23, only one sheet of paper is sent out to the first paper carrying path 23 by the effect of a separation member provided on a tilting separation surface 20A provided on the left side of the first paper supply cassette 20 (see FIG. 2).

The second supply roller 30 is located on the rear side of the second paper supply cassette 21 (i.e., on the left side on FIG. 2). The second supply roller 30 feeds the sheet of paper stacked on the second paper supply cassette 21 to the second paper carrying path 24. The second supply roller 30 is rotated while being applied a driving force in a counterclockwise (CCW) direction from the ASF motor 65 (see FIG. 5) via a gear transmission mechanism (not shown). The second supply roller 30 is pivotally supported at a tip of a second arm 31. A proximal end of the second arm 31 is pivotally attached to a driving shaft 33 installed on the upper side of the second paper supply cassette 21. Therefore, the second supply roller 30 is able to move in a vertical direction to contact or detach from the second paper supply cassette 21.

The second arm 31 is rotated downward through its own weight or a spring (not shown) so that the second arm 31 is able to move upward or downward depending on the amount of the staked sheets of paper accommodated in the second paper supply cassette 21. Consequently, the second supply roller 30 contacts the top of the sheets of paper stacked on the second paper supply cassette 21. When the second supply roller 30 is rotated in this state, at least a sheet of paper on the top of the stacked sheets is supplied toward the second paper carrying path 24 due to friction between a surface of the second supply roller 30 and the sheet of paper. Even if a plurality of sheets of paper are supplied by the second supply roller 30 toward the second paper carrying path 24, only one sheet of paper is sent out to the second paper carrying path 24 by the effect of a separation member provided on a tilting separation surface 21A provided on the left side of the second paper supply cassette 21 (see FIG. 2).

In this embodiment, the first supply roller 25 or the second supply roller 30 is rotated while being applied a driving force in a clockwise direction or in a counterclockwise direction transmitted form the ASF motor 65. On a transmission path between the ASF motor 65 and the first supply roller 25 or the second supply roller 30, a transmission switch mechanism, such as a one-way clutch or a planet gear, is provided. Therefore, when the ASF motor 65 is rotated in the clockwise direction, the driving force is transmitted only to the first supply roller 25 and transmission of the driving force to the second supply roller 30 is cut off. On the other hand, when the ASF motor 65 is rotated in the counterclockwise direction, the driving force is transmitted only to the second supply roller 30 and transmission of the driving force to the first supply roller 25 is cut off.

The first paper carrying path 23 is formed on the upper side at the tip of the first paper supply cassette 20. The first paper carrying path 23 extends upward from the rear end of the first paper supply cassette 20, turns toward the front side, extends from the rear side to the front side of the MFP 10 (i.e., toward the right side on FIG. 2), and finally connects to the top surface 22 of the first paper supply cassette 20 via the image recordation unit 41. That is, the first paper carrying path 23 is formed to have a shape of a horizontally-oriented letter U (see FIG. 2). The first paper carrying path 23 is formed of an outer guide face and an inner guide face located to face with each other to have a predetermined interval, excepting a portion around the image recordation unit 41.

The second paper carrying path 24 is formed on the upper side at the tip of the second paper supply cassette 21. Similarly to the first paper carrying path 23, the second paper carrying path 24 is formed to have a shape of a horizontally-oriented letter U (see FIG. 2) so that the second paper carrying path 24 connects to the top surface 22 of the first paper supply cassette 20. The second paper carrying path 24 is merged with the first paper carrying path 23 on the upstream side with respect to the image recordation unit 41, and a single carrying path is formed on the downstream side with respect to a merging point. Similarly to the first paper carrying path 23, the second paper carrying path 24 is formed of an outer guide face and an inner guide face located to face with each other to have a predetermined interval, excepting a portion around the image recordation unit 41.

As shown in FIG. 2, the image recordation unit 41 is provided on the first paper carrying path 23. The image recordation unit 41 forms an image on the sheet of paper being carrying along the first paper carrying path 23. More specifically, the image recordation unit 41 includes a carriage 38 and a recording head 39 forming an image in an inkjet printing manner.

As shown in FIG. 3, a pair of guide rails 43 and 44 are installed on the upper side of the first paper carrying path 23. On the upper side of the first paper carrying path 23, the pair of guide rails 43 and 44 are positioned to have a predetermined interval in a paper carrying direction, and each of the guide rails 43 and 44 extends in a direction (indicated by an arrow 101 in FIG. 3) perpendicular to the paper carrying direction. The guide rails 43 and 44 are installed in the casing 15 of the print unit 11, and form a part of a frame supporting various components in the print unit 11. The carriage 38 is provided to bridge the guide rails 43 and 44, and is able to reciprocate in the direction perpendicular to the paper carrying direction.

The guide rail 43 located on the upstream side in the paper carrying direction has a plate-like shape having the size in the direction of the width of the first paper carrying path 23 (i.e., the size in the direction indicated by the arrow 101) longer than a reciprocating motion range of the carriage 38. The guide rail 44 located on the downstream side in the paper carrying direction has a plate-like shape having the size in the direction of the width of the first paper carrying path 23 substantially equal to that of the guide rail 43.

An edge of the carriage 38 on the upstream side in the paper carrying direction is mounted on the guide rail 43, and an edge of the carriage 38 on the downstream side is mounted on the guide rail 44 so that the carriage 38 is able to slide along the lengthwise direction of the guide rails 43 and 44. An edge 45 of the guide rail 44 on the upstream side in the paper carrying direction is formed to bend upward at substantially the right angle. The carriage 38 supported by the guide rails 43 and 44 slidably holds the edge 45 with a holding member, such as a pair of rollers. In this structure, the carriage 3 8 is positioned with respect to the paper carrying direction and is able to slide in the direction perpendicular to the paper carrying direction.

On the top surface of the guide rail 44, a belt drive mechanism 46 is provided. In the belt drive mechanism 46, a drive pulley (not shown) and a driven pulley 48 are provided at respective ends in the width direction of the first paper carrying path 23 (i.e., in the direction indicated by the arrow 101). A ring-shaped endless belt 49 provided with a teeth on its inner surface is hung to the drive pulley and the driven pulley 48. It should be noted that the drive pulley hides behind the carriage 38.

A driving force is applied to a shaft of the drive pulley from a CR motor (not shown), and the belt 49 rotates through rotations of the drive pulley. Although in this embodiment the endless belt 49 is used, a belt having ends configured such that the carriage 38 is fixed to the ends may be used in place of the endless belt 49.

The guide rail 43 is provided with a lever guide 91. It should be noted that the lever guide 91 is omitted in FIG. 4 for the sake of simplicity. The lever guide 91 is fitted into a fitting hole (not shown) formed in the guide rail 43 on the side of a maintenance mechanism 55 to be fixed with respect to the guide rail 43. The drive switch mechanism 70 is located under the lever guide 91. The lever guide 91 is a plate-like member in which guide holes 95 are formed on its inner surface (see FIG. 5). An input part 77 of an input lever 74 is inserted into the guide hole 95 from the lower side to protrude on the upper side of the guide rail 43. The input part 77 inserted into the guide hole 95 is kept at a first drive transmission position PI at the inside edge of the guide hole 95 when no external force is applied to the input part 77.

The carriage 38 is fixed to the endless belt 49 at the bottom surface of the carriage 38. In this structure, in accordance with rotational motion of the endless belt 49 by the CR motor (not shown), the carriage 38 reciprocates on the guide rails 43 and 44 with respect to the edge 45. Therefore, the recording head 39 mounted on the carriage 38 also reciprocates in the width direction of the paper carrying path 23 (i.e., in the direction indicated by the arrow 101).

As shown in FIG. 3, at an upstream edge of the carriage 38, a guide member 92 is formed to protrude upward. The guide member 92 reciprocates in the lengthwise direction of the guide rail 43 together with the carriage 38. In accordance with movement of the carriage 38, the guide member 92 contacts the input part 77 (see FIG. 4) protruding upward from the guide hole 95 (see FIG. 5) of the guide rail 43. Thus, the position of the input lever 74 can be changed. The position of the input lever 74 can be changed to a desired position by controlling the reciprocating motion of the carriage 38. When the input lever 74 is set to a certain position (i.e., one of first to third drive transmission positions P1-P3), a first switch gear 71 and a second switch gear 72 of the gear unit 110 are also set to respective positions.

As shown in FIGS. 2 and 3, under the first paper carrying path 23, a platen 42 is provided to face the recording head 39. The platen 42 is installed, within the reciprocating motion range of the carriage 38, to extend over a central portion where the sheet of paper passes. The width (i.e., the length in the direction indicated by the arrow 101 in FIG. 2) of the platen 42 is sufficiently larger than the maximum available paper size of the MFP 10. The sheet of paper is held on the platen 42 to have a constant interval with respect to the recording head 39. In this state, drops of ink ejected from the recording head 39 fall on the sheet of paper.

As shown in FIG. 2, on the upstream side of the image recordation unit 41 in the paper carrying direction 104, a pair of rollers 60 and 61 (i.e., a carrying roller 60 and a pinch roller 61) are provided. The pinch roller 61 is positioned under the carrying roller 60 to contact and press the outer surface of the carrying roller 60. The carrying roller is rotated continuously while being applied a driving force from a LF (Line Feed) motor 66 provided in the print unit 11, or is driven intermittently at predetermined line feed widths. When the sheet of paper enters between the carrying roller 61 and the pinch roller 60, the sheet of paper is carried to the platen 42 while being sandwiched between the carrying roller 60 and the pinch roller 61.

On the downstream side of the image recordation unit 41 in the paper carrying direction 104, an ejection roller 62 and a wheel 63 are provided. The wheel 63 is located on the upper side of the ejection roller 62 to contact and press the outer surface of the ejection roller 62. Between the carrying roller 60 and the ejection roller 62, a drive transmission mechanism, such as a gear, is provided. The ejection roller 62 is continuously rotated concurrently with the carrying roller 60 while being applied the driving force from the LF motor 66 via the drive transmission mechanism or is driven intermittently at predetermined line feed widths. The ejection roller 62 and the wheel 63 carry the sheet of paper to the top surface 22 of the first paper supply cassette 20 while sandwiching the sheet of paper therebetween.

As shown in FIG. 3, the maintenance mechanism 53 is positioned at one end in the width direction (the direction indicated by the arrow 101) of the platen 42, and a flushing unit 56 is positioned at the other end in the width direction of the platen 42. On FIG. 3, the maintenance mechanism 53 is provided at the left end portion, and the flushing unit 56 is provided at the right end portion. The flushing unit 56 is configured to receive waste ink ejected from the recording head 39 in the flushing ejection motion. In the flushing unit 56, an ink absorption body, such as a sponge or felt, is provided. The ink ejected in the flushing ejection motion is absorbed by the ink absorption body, such as a sponge or felt.

The maintenance mechanism 55 is configured to keep the recording head 39 to constantly achieve optimum performance. More specifically, the maintenance mechanism 55 has a function of executing a negative-pressure purge motion to suck air bubbles or foreign material from nozzles of the recording head 39, a function of executing a wiping motion of cleaning the nuzzle surface of the recording head 39 with a wiper, and a function of executing an evacuation motion of removing air bubbles in a sub-tank provided in the recording head 39. The maintenance mechanism 55 has a cap 57 for covering the nuzzles of the recording head 39 or an exhaust hole of the recording head 39. The cap 57 is moved up and down by a lift up mechanism 51 (see FIG. 3) to contact or detach from the surface of the exhaust hole or the nozzle surface of the recording head 39. The maintenance mechanism 55 has a suction pump 52 (see FIG. 5), although it is not shown in FIG. 3. The suction pump 52 communicates with the cap 57 so that when the suction pump 52 is activated, the inside of the cap 57 is kept in a negative pressure state. When the suction pump 52 is activated in a state where the cap 57 contacts and covers the nozzles and the exhaust hole, air bubbles or foreign material is sucked and removed from the recording head. The suction pump 52 of the maintenance mechanism 55 is activated while being applied the driving force transmitted from the LF motor 66. The lift up mechanism 51 is activated while being applied the driving force transmitted from the ASF motor 65. That is, each of the suction pump 52 and the lift up mechanism 51 serves as a driving unit. As describe above, the maintenance motion for removing air bubbles and mixed ink from the recording head 39 and for preventing the recording unit 39 from drying is performed.

Hereafter, the drive switch mechanism 70 is described. The drive switch mechanism 70 serves to switch the driving force from the ASF motor 65 and the LF motor 66 between driving units including the first supply roller 25, the second supply roller 30, the suction pump 52, and the lift up mechanism 51. The drive switch mechanism 70 is located on the right side (i.e., on the left side on FIG. 3) of the frame formed by the guide rails 44 and 45. The drive switch mechanism 70 transmits the driving forces transmitted separately in two routs from the ASF motor 65 and the LF motor 66, to the driving units selectively.

As shown in FIGS. 4 and 5, the drive switch mechanism 70 includes a gear unit 110 and a support frame 120 supporting the gear unit 110. The gear unit 110 includes a first switch gear 71 and a second switch 72. In the gear unit 110, each of the first and second switch gears 71 and 72 is supported on a single support shaft 74 to be rotatable about a support shaft 73 and slidable on the support shaft 73 in the axial direction. It should be noted that the left side on FIG. 5 corresponds to the inside of the MFP 10.

As shown in FIG. 5, the driving force of the ASF motor 65 is transmitted to the first switch gear 71. Therefore, the first switch gear 71 is rotated by the rotational driving force received from the ASF motor 65. A series of gears may be used as a transmission mechanism for transmitting the driving force form the ASP motor 65 to the first switch gear 71. In this case, the series of gears are provided between an output gear 75 and the first switch gear 71 to transmit the rotational driving force from the ASf motor 65 to the first switch gear 71. Since the thickness (i.e., the length in the axial direction) of a transmission gear 67 in the series of gears is sufficiently larger than the sliding range of the first switch gear 71 along the support axis 73, the first switch gear 71 and the transmission gear 67 are able to constantly engage with each other within the sliding range of the first switch gear 71. That is, the first switch gear 71 is able to move along the axial direction of the support haft 73 while engaging with the transmission gear 67.

The driving force of the LF motor 66 is transmitted to the second switch gear 72. The second switch gear 72 is rotated by the driving force received from the LF motor 66. As an example of a transmission mechanism for transmitting the driving force from the LF motor 66 to the second switch gear 72, a transmission gear may be provided on a side of the carrying motor 60 to have a common axis with respect to the carrying roller 60 and to rotate concurrently with the carrying roller 60 (i.e., the transmission gear may be formed integrally with the carrying roller 60), and a series of gears including a plurality of gears may be provided to connect the transmission gear with the second switch gear 72. An output gear 76 of he LF motor 66 engages with the other side of the carrying motor with a gear mechanism. When the driving force from the LF motor 66 is applied to the other side of the carrying roller 60, the carrying roller 60 is rotated and the second switch gear 72 is rotated in accordance with the driving force of the LF motor 66. Since the thickness (i.e., the length in the axial direction) of the transmission gear 68 in the series of gears is sufficiently larger than the sliding range of the second switch gear 72 along the support axis 73, the second switch gear 72 and the transmission gear 68 are able to constantly engage with each other within the sliding range of the second switch gear 72. That is, the second switch gear 72 is able to move along the axial direction of the support haft 73 while engaging with the transmission gear 68.

Hereafter, the gear unit 110 is described.

As shown in FIG. 5, the gear unit 110 is configured such that a first coil spring 111 and a second coil spring 112 as well as the fist and second gears 71 and 72 and the input lever 74 are supported on the support shaft 73. The first and second coil springs 111 and 112, the first and second gears 71 and 72 and the input lever 74 are supported on the support shaft 73 to be slidable on the support shaft 73. The support shaft 73 is supported horizontally by the support frame 120.

The first switch gear 71 is positioned on the outer side (i.e., on the right side on FIG. 5), and the second switch gear 72 is positioned on the inner side (i.e., on the left side on FIG. 5). The axial direction of the support shaft 73 is equivalent to the reciprocating direction of the carriage 38. By sliding the first switch gear 71 and the second switch gear 72, the first switch ear 71 is selectively engaged with one of a first transmission gear 171 and a second transmission gear 172. The second switch gear 72 is selectively set to one of a free state and an engaged state of being engaged with a third transmission gear 173.

As shown in FIG. 4, each of the first and second switch gears 71 and 72 is configured such that an edge part in a radial direction is chamfered. Further, each of the transmission gears 171 to 173 is configured such that an edge part in a radial direction is chamfered, although they are not illustrated. The chamfering of these gears aims to ease the engagement between the first and second switch gear 71 and 72 and the transmission gears 171 to 173.

The second switch gear 72 is provided with a cylinder part 79 extending toward the side of the first switch gear 71. The cylinder part 79 is formed such that a tip end thereof contacts the first switch gear 71 so as to serve to keep the distance between the first switch gear 71 and the second switch gear 72 at a constant value. The cylinder part 79 further serves to transmit the pressing force of the second coil spring 112 to the first switch gear 71. The size of the cylinder part 79 may be determined in accordance with the thicknesses of the transmission gears 171 to 173 and the number of transmission gears.

The input lever 74 is positioned on the outer side of the first switch gear 71 (i.e., on the right side on FIG. 5). Through the effect of the input lever 74 and the lever guide 91, the position of the first switch gear 71 is set to one of positions to be engaged with the first transmission gear 171 and the second transmission gear 172, and the position of the second switch gear 72 is set to one of the free position and the position to be engaged with the third transmission gear 173. That is, the input lever 74 and the lever guide 91 serve as a positioning unit.

As shown in FIG. 5, the input lever 74 has a cylindrical part 78 into which the support shaft 73 is fitted, and an input part 77 formed to protrude from the cylindrical part 78. In a state where the gear unit 110 is mounted on the support frame 120, the input part 77 of the input lever 74 is inserted into the guide hole 95 of the lever guide 95 through an opening 122 (which is described later). The cylindrical part 78 into which the support shaft 73 is fitted is able to slide in the axial direction and is rotatable about the support shaft 73. When the cylindrical part 78 slides, the input part 77 slides in the axial direction. When the cylindrical part 78 rotates, the input part 77 rotates in the same rotational direction.

The first coil spring 111 is positioned on the outer side of the input lever 74 (i.e., on the right side on FIG. 5). The second coil spring 112 is positioned on the inner side of the second switch gear 72 (i.e., on the left side on FIG. 5).

In the sate where the gear unit 110 is mounted on the support frame 120, each of the first coil spring 111 and the second coil spring 112 is in a compressed state. That is, each of the first and second coil spring 111 and 112 serves as a compression spring.

Each of the first and second coil springs 111 and 112 is provided to be able to expand and contract in the axial direction of the support shaft 73. The input lever 74 is pressed by the first coil spring 111 toward the side of the first switch gear 71 (i.e., in the direction indicated by an arrow 85 in FIG. 5). The second switch gear 72 is pressed by the second coil spring 112 toward the side of the first switch gear 71 (i.e., in the direction indicated by an arrow 86 in FIG. 5). That is, the first switch gear 71 and the second switch gear 72 are pressed to approach with respect to each other by the two coil springs 111 and 112 which produce pressing forces in directions opposite to each other. In the state where the first switch gear 71 and the second switch gear 72 contact with each other by the pressing forces from the two coil springs 111 and 112, the first and second switch gears 71 and 72 are able to rotate separately with respect to each other.

In this embodiment, the pressing force of the first coil spring 111 (i.e., the pressing force indicated by the arrow 85) is larger than the pressing force of the second coil spring 112 (i.e., the pressing force indicated by the arrow 86). Therefore, when no external force is applied, the second switch gear 72, the first switch gear 71 and the input lever 74 are pressed toward the first coil spring 111 to compress the second coil spring 112 and to slide along the support shaft 73 in the direction indicated by the arrow 85. When the input part 77 of the input lever 74 contacts the inner edge part of the guide hole 95 (i.e., the left edge part in FIG. 5), the sliding of the members in the direction of the arrow 85 stopped. In this state, the input part 77 is positioned at the first drive transmission position P1. At the first drive transmission position P1, the first switch gear 71 engages with the second transmission gear 172, and the second switch gear 72 is in the free state. When the guide member 92 contacts the input part 77 and the input part 77 is pressed by the guide member 92, the input part 77 moves to the second drive transmission position P2 or the third drive transmission position P3 to switch the transmission state of the driving force.

As shown in FIG. 4, on the top surface 121 of the support frame 120, the opening 122 is formed. The opening 122 has a shape elongated in the axial direction of the support shaft 73. In the state where the gear unit 110 is mounted on the support frame 120, the input part 77 of the input lever 74 is inserted into the opening 122. The width of the opening 122 (i.e., the size in the axial direction of the support shaft 73) is set to have a value larger than the moving range of the input lever 74. Therefore, movement of the input lever 74 is not limited by the opening 122.

Hereafter, the transmission gears 171 to 173 are explained.

As shown in FIG. 5, under the first and second switch gears 171 and 172, the first to third transmission gears 171 to 173 are provided in parallel with the support shaft 73 so that the first to third transmission gears 171 to 173 are supported on a support shaft 180 which is in parallel with the support shaft 73.

The first and second transmission gears 171 and 172 are positioned to be able to engage with the first switch gear 71. The third transmission gear 173 is positioned to be able to engage with the second switch gear 72. The first, second and third transmission gears 171, 172 and 173 have thicknesses different from each other, and have the same outer diameter. The first, second and third transmission gears 171, 172 and 173 are arranged in this order from the outside on the support shaft 180.

Each of the first to third transmission gears 171-173 serves to transmit the driving force to the corresponding drive mechanism. As shown in FIG. 5, the first transmission gear 171 transmits the driving force to the lift up mechanism for moving vertically the cap 57. The second transmission gear 172 transmits the driving force to the first supply roller 25 and the second supply roller 30. The third transmission gear 173 transmits the driving force, for example, to the suction pump 52 of the maintenance mechanism 5. As described above, the first to third transmission gears 171-173 are assigned to respective driving mechanisms. Various types of transmission mechanisms, such as a series of gears or a belt, may be used as a transmission mechanism between each of the first to third transmission gears 171-173 and the corresponding drive mechanisms.

FIG. 6A illustrates a state where the input part 77 of the input lever 74 is positioned at the first drive transmission position P1. In the state shown in FIG. 6A, the first switch gear 71 engages with the second transmission gear 172, and the second switch gear 72 is in the free state. When the input part 77 of the input lever 74 is moved to the second drive transmission position P2 as shown in FIG. 6B, the first switch gear 71 moves away from the second transmission gear 172, and engages with the first transmission gear 171. In this case, the second switch gear 72 stays in the free state. When the input part 77 of the input lever is moved to the third drive transmission position P3, the first switch gear 71 slides while engaging with the first transmission gear 171. In this case, the second switch gear 72 moves from the free state to the state of being engaged with the third transmission gear 173.

As shown in FIG. 7A, when the first switch gear 71 moves away from the second transmission gear 172 and engages with the first transmission gear 171, a possibility that the first switch gear 71 does not properly engage with the first transmission gear 171 arises. Further, by the effect of a surface pressure acting between the first switch gear 71 and the first transmission gear 171 may cause a phenomenon that the first switch gear 71 does not properly move away from the second transmission gear 172. In this case, even if the input part 77 of the input lever 74 is moved to the second drive transmission position P2, the first switch gear 71 is not properly engaged with the first transmission gear 171. Furthermore, as shown in FIG. 7B, when the second switch gear 72 is driven to move to the free state to the state of being engaged with the third transmission gear 173, a possibility that the second switch gear 72 does not properly engage with the third transmission gear 173. For this reason, in this embodiment, each of the first and second switch gears 71 and 72 is rotated by a predetermined rotational amount when the drive transmission state of the first and second switch gears 71 and 72 is switched in accordance with a motor control process of the motor control unit 130 shown in FIG. 9. Consequently, the surface pressure between surfaces of engaged gears is released, and teeth of gears to be engaged are arranged to be able to properly engage with each other. Therefore, switching of the drive transmission state of the first and second switch gears 71 and 72 can be properly performed.

Hereafter, the configuration of the motor control unit 130 is explained with reference to FIG. 8. FIG. 8 is a block diagram illustrating a configuration of the motor control unit 130. in FIG. 8, a transmission oath from each of the motors 65 and 66 is surrounded by a box indicated by a dashed line. As described below, the motor control unit 130 serves to control the ASF motor 65 and the LF motor 66. The motor control unit 130 may be configured as a separate control unit provided separately from a main controller for controlling totally the functions of the MFP 10, or may be embedded in such a main controller. The CR motor for driving the carriage 38 is also controlled by the motor control unit 130 although a configuration for controlling the CR motor is omitted from FIG. 8 for the sake of simplicity.

As shown in FIG. 8, the motor control unit 130 includes a CPU 131, a ROM 132, a RAM 133, an ASIC 136, a driving circuit 137, which are connected to each other via a bus 135.

The ROM 132 stores a program for executing the motor control process for controlling the ASF motor 65 and the LF motor 66. FIG. 9 is a flowchart illustrating the motor control process. The ROM 132 further stores a program for controlling switching of the ASF motor 65 and the LF motor 66 in accordance with detection signals from sensors, such as rotary encoders 81 and 82 and for controlling the rotation amount of the ASF motor 65 and the LF motor 66.

The RAM 133 is used by the CPU 131 as a work memory for storing temporarily various types of data used for the above described programs. In the RAM 133, a memory area for storing the number of counts of the motor control executed by the CPU 131 is secured.

In accordance with instructions from the CPU 131, the ASIC 136 generates various control signals, such as a PWM signal, to be applied to the ASF motor 65 and the LF motor 66, and sends the signals to the driving circuits 137 and 138. By applying the driving signal to the ASF motor 65 via the driving circuit 137, control of rotations of the ASF motor 65 is performed under control of the motor control unit 130. By applying the driving signal to the LF motor 66 via the driving circuit 138, control of rotations of the LF motor 66 is performed under control of the motor control unit 130.

The driving circuit 137 serves to drive the ASF motor 65 connected to the first and second supply rollers 25 and 30. By receiving the output signal from the ASIC 136, the driving circuit 137 generates the drive signal to rotate the ASF motor 65 in the clockwise direction or in the counterclockwise direction. By receiving the drive signal from the driving circuit 137, the ASF motor 65 rotates in a certain rotational direction. The rotation of the ASF motor 65 is transmitted to the first and second supply rollers 25 and 30 via the drive transmission mechanism, such as a gear provided on the transmission path between the ASF motor 65 and each of the first and second supply rollers 25 and 30.

The driving circuit 138 serves to drive the LF motor 66 connected to the carrying roller 60. By receiving the output signal from the ASIC 136, the driving circuit 138 generates the drive signal to rotate the LF motor 66 in a certain rotational direction. By receiving the drive signal from the driving circuit 138, the LF motor 66 rotates in a certain rotational direction. The rotation of the LF motor 66 is transmitted to the carrying roller 60 via the drive transmission mechanism, such as a gear provided on the transmission path between the LF motor 66 and the carrying motor 60.

To the ASIC 136, the rotary encoders 81 and 82 are connected. The rotary encoder 81 serves to detect the rotation amount of the ASF motor 65, and is attached to the ASF motor 65. The rotary encoder 82 serves to detect the rotation amount of the carrying roller 60 and the LF motor 66, and is attached to the carrying roller 60.

Each of the rotary encoders 81 and 82 includes an encoder disk and an optical sensor which are provided to have a common axis with respect to a rotational axis. When the encoder disk rotates together with the rotational axis, the optical sensor outputs pulses. The signal (pulses) detected by the rotary encoders 81 and 82 is sent to the CPU 131 via the ASIC 136 and the bus 135. Based on the detection signal from the rotary encoders 81 and 82, the CPU 131 measures the rotation amount of each of the motors 65 and 66 or detects a malfunction of the rotational motion of each of the motors 65 and 66.

The drive control of the ASF motor 65 and the LF motor 66 executed under control of the CPU 131 will now be explained with reference to the flowchart of the motor control process shown in FIG. 9 and a timing chart shown in FIG. 10. The motor control process is executed when the input lever 74 is moved from the first drive transmission position P1 to the second drive transmission position P3 or when the input lever 74 is moved from the first drive transmission position P2 to the third drive transmission position P3.

When the motor control process is started, the CPU 131 resets the count C stored in a count memory area in the RAM 133. Then, an ASF motor control process in steps S10 to S13 and an LF motor control process in steps S20 to S21 are executed concurrently. Although FIG. 9 is illustrated such that the control flow is branched from step S1 to steps S10 and S20 for convenience of explanation, actually the ASF motor control and the LF motor control are executed as separate processes.

In the ASF motor control process (steps S10 to S13), the ASF motor 65 is rotated by a certain rotation amount in the clockwise direction, and is then rotated by a certain rotation amount in the counterclockwise direction, and thereafter the ASF motor 65 is stopped. First, the CPU 131 activates the ASF motor 65 to rotate the ASF motor 65 by a certain rotation amount in the clockwise direction (step S10). More specifically, the CPU 131 rotates the ASF motor 65 by a rotation amount corresponding to 1154 pulses (hereafter, frequently referred to as "1154ENC") with reference to the pulse signal from the rotary encoder 81. The 1154 pulses correspond to the rotation amount for rotating the first switch gear 71 by 2.7 teeth of the transmission gears 171 and 172. That is, if the ASF motor 65 is rotated by the rotation amount of 1154 pulses when the first switch gear 71 and the first transmission gear 171 (or the second transmission gear 172) engage with each other, the first transmission gear 171 rotates by the rotation amount corresponding to 2.7 teeth.

When the ASF motor 65 is started from the stopped state, the ASP motor 65 is accelerated until a predetermined rotational speed is reached (729 $min^{-1}$ in this embodiment). Thereafter, the ASF motor 65 is controlled to keep constantly the predetermined speed, and is decelerated to be stopped again (see the upper timing chart in FIG. 10). When the driving finishes in step S10, the CPU 131 waits 100 ms (step S11). Then, the CPU 131 rotates the ASF motor 65 in a predetermined rotation amount in the counterclockwise direction (step S12). After the driving is finished in step S12, the CPU 131 waits 200 ms (step S13). After waiting of 200 ms is finished, the CPU 131 sets an end flag for ASF motor control. Then, control proceeds to step S14.

In this embodiment, the ASF motor 65 is rotated by the rotation amount corresponding to 2.7 teeth of the transmission gears 171 and 172 in steps S10 and S12. It should be noted that the rotation amount is determined in consideration of loss of rotation, such as backlash and a stopping error of gears. Therefore, for proper engagement between the first switch gear 71 and the first and second transmission gears 171 and 172, the rotation amount of the first switch gear 71 may be one tooth of the first and second transmission gears 171 and 172 at the minimum. That is, even if the loss of rotation, such as backlash and a stopping error of gears, is taken into consideration, the ASF motor 65 may be rotated by the rotation amount for rotating the first switch gear 71 by an amount corresponding to one tooth of the first and second transmission gears 171 and 172.

In step S14, the CPU 131 judges whether the LF motor control is finished. In step S14, the judgment may be made by setting the end flag to a register of the CPU 131 or to the RAM 133 when the LF motor control is finished, and checking the status of the end flag.

As described below, in the LF motor control in steps S20 to S21, the LF motor 66 is rotated in the counterclockwise direction by a predetermined rotation amount, and thereafter the LF motor 66 is stopped. First, the CPU 131 activates the LF motor 66 at the same timing when the ASF motor 66 is activated, and rotates the LF motor 66 in the clockwise direction by the predetermined amount (step S20). More specifically, the CPU 131 rotates the LF motor 66 by 1024 pulses (1024ENC) with reference the pulse signal from the rotary encoder 82. The 1024 pulses correspond to the rotation amount for rotating the second switch gear 72 by 2.25 teeth with reference to teeth of the third transmission gear 173. That is, if the LF motor 66 is rotated by the rotation amount of 1.24 pulses when the second switch gear 72 and the third transmission gear 173 engage with each other, the third transmission gear 173 rotates by the rotation amount of 2.25 teeth.

After rotation of the LF motor 66 is started from the stopped state, the LF motor 66 is accelerated until a predetermined rotational speed is reached (140 $min^{-1}$ in this embodiment). Thereafter, the LF motor 66 is controlled to keep constantly the predetermined speed, and is decelerated to be stopped again (see the lower timing chart in FIG. 10). When the driving finishes in step S20, the CPU 131 waits 200 ms (step S21). After waiting of 200 ms is finished, the CPU 131 sets an end flag for LF motor control. Then, control proceeds to step S22.

In this embodiment, the LF motor 66 is rotated by the rotation amount corresponding to 2.25 teeth of the third transmission gear 173 and 172 in step S20. It should be noted that the rotation amount is determined in consideration of loss of rotation, such as backlash and a stopping error of gears. Therefore, for proper engagement between the second switch gear 72 and the third transmission gear 173, the rotation amount of the second switch gear 72 may be one tooth of the third transmission gear 173 at the minimum. That is, even if the loss of rotation, such as backlash and a stopping error of gears, is taken into consideration, the LF motor 66 may be rotated by the rotation amount for rotating the second switch gear 72 by an amount corresponding to one tooth of the third transmission gear 173.

In step S20, the CPU 131 judges whether the ASF motor control is finished. In step S20, the judgment may be made by setting the end flag to a register of the CPU 131 or to the RAM 133 when the ASF motor control is finished, and checking the status of the end flag.

When the CPU 131 judges that the motor control is finished in step S14 or S22 (S14: YES or S22: YES), control proceeds to step S30 where the count C is incremented.

In step S31, the CPU 131 judges whether the count C is equal to a predetermined count n. In this embodiment, the predetermined count n has been set to 3. In is understood that various numbers may be assigned to the predetermined number n. If the CPU 131 judges that that the count C is equal to n (C=n), the motor control process terminates. On the other hand, if the CPU 131 judges that the count C is not equal to n (C≠n), the ASF motor control (steps S10-S13) and the LF motor control (steps S20-21) are executed concurrently again. The ASF motor control and the LF motor control are executed until the condition C=n is satisfied in step S14.

According to the embodiment, the ASF motor control and the LF motor control are executed as described above. Therefore, as shown in FIG. 10, an acceleration timing of the ASF motor 65 and an acceleration timing of the LF motor 65 can be overlapped (see a time T10). Although the acceleration timing of the ASF motor and the acceleration timing of the LF motor 65 do not completely overlap with each other, at least parts of the acceleration timing of the motors 65 and 66 overlap with each other in a time period between the activation of the motors and the time when one of the motors 65 and 66 reaches a constant speed. Immediately after activation of the motors 65 and 66, each of the motors 65 and 66 rotates at a low speed. Therefore, in this low speed state, engagement of each of the first and second switch gears 71 and 72 is easily switched. That is, the first switch gear 71 is easily switched from the second transmission gear 172 to the first transmission gear 171, and the second switch gear 72 is easily switched from the free state to the engaged state of being engaged with the third transmission gear 173. Consequently, it is possible to engage each of the switch gears 71 and 72 to the corresponding one of the first to third transmission gears 171-173 quickly and reliably.

As shown in FIG. 10, a deceleration timing T11 is defined for the driving control of the ASF motor 65 in the clockwise direction. Therefore, even if the switching can not be achieved in the acceleration timing T10 immediately after the activation of each motor, at least the first switch gear 71 moves to the state of being able to easily switch from the second transmission gear 172 to the first transmission gear 171 in the deceleration timing T11. In this timing, although the LF motor 66 is rotated at the constant speed (see the lower timing chart in FIG. 10), the first switch gear 71 is in the state of being able to switch easily in comparison with the case where the LF motor 66 is stopped because the phase of the gear 71 shifts (with respect to the transmission gear) as long as the LF motor 66 is rotated. The same holds true for the rotation of the ASF motor 65 in the counterclockwise direction because the acceleration timing T12 is secured.

In the ASF motor control (steps S10-S13) and the LF motor control (steps S20-S22), the motors 65 and 66 may be controlled such that the stop timing in the drive control in step S12 and the stop timing in the drive control in step S20 substantially match with each other. In other words, the ASF motor control may be finished at substantially the same timing when the LF motor control is finished. In this case, as shown in FIG. 10, the deceleration timing (T13) of the AF motor 65 can be overlapped with the deceleration timing (T13) of the LF motor 66. Therefore, even in the condition immediately before the stop of the motor, each of the first and second switch gears 71 and 72 is in the state of being easily switched.

In the motor control process shown in FIG. 9, the ASF motor 65 is rotated in the clockwise direction when the ASF motor 65 is activated, and the LF motor 66 is rotated in the clockwise direction when the LF motor 66 is activated. However, as shown by a thick dashed line in FIG. 10, the ASF motor 65 may be rotated in the counterclockwise direction when the ASF motor 65 is activated, and the LF motor 66 may be rotated in the counterclockwise direction when the LF motor 66 is activated.

In the motor control process shown in FIG. 9, the ASF motor 65 and the LF motor 66 are activated at the same timing. However, the timing of activating the ASF motor 65 and the timing of activating the LF motor 66 may be different from each other. That is, as long as at least the ASF motor is activated while the LF motor 66 rotates, the timing of activating the ASF motor 65 and the timing of activating the LF motor 66 may be different from each other. In this case, even if the acceleration timings of the ASF motor 65 and the LF motor 66 do not overlap with each other, the first switch gear 71 rotates at a low speed in the state where the surface pressure between gears is released because the ASF motor 65 is reversely accelerated while the LF motor 66 is rotated. Consequently, the first switch gear 71 is in the sate of being easily switched in comparison with the case where the LF motor 66 is stopped.

In the following, variations of the motor control process and the timing chart of control of the motors are explained.

(First Variation)

As a first variation of the motor control process and timing chart, FIG. 11 illustrates a flowchart of a motor control process, and FIG. 12 illustrates timing chart of control of motors. The motor control process is executed when the input lever 74 is moved from the first drive transmission position P1 to the second drive transmission position P3 or when the input lever 74 is moved from the first drive transmission position P2 to the third drive transmission position P3. In FIG. 11, to steps which are substantially the same as those of FIG. 9, the same step numbers are assigned, and explanations thereof will not be repeated for the sake of simplicity.

When the count C is reset in step S1, ASF motor control in steps S110 to S113 and LF motor control in steps S120 to S124 are executed concurrently. Although FIG. 11 is illustrated such that the control flow is branched from step S1 to steps S110 and S120 for convenience of explanation, actually the ASF motor control and the LF motor control are executed as separate processes.

In the ASF motor control process (steps S110 to S112), the drive control where the ASF motor 65 is rotated by a certain rotation amount in the clockwise direction, and is then rotated by a certain rotation amount in the counterclockwise direction, and thereafter the ASF motor 65 is stopped is executed two times repeatedly (see the upper timing chart in FIG. 12). First, in step S110, the same steps as steps S10 to S13 in FIG. 9 are executed (step S110). Then, the CPU 131 judges whether the first waiting time of 200 ms for the LF motor control has elapsed (step S111). The CPU 131 waits until the first waiting time elapses (S111: NO).

If the CPU 131 judges that the first waiting time has elapsed (S111: YES), control proceeds to step S112 where the same steps S10-S13 as those in step S110 are executed at the same timing as step S122. Next, in step S113, the CPU 113 judges whether the LF motor control is finished as in the case of step S14.

In the LF motor control process (steps S120 to S123), the LF motor 66 is rotated by a certain rotation amount in the clockwise direction, and is then rotated by a certain rotation amount in the counterclockwise direction, and thereafter the LF motor 66 is stopped. First, in step S120, the same steps as steps S20 to S21 in FIG. 9 are executed. Then, the CPU 131 judges whether the first waiting time of 100 ms for the ASF moor control elapses (step S121). The CPU 131 waits until the waiting time elapses (S121: NO). When the waiting time elapses (S121: YES9, control proceeds to step S122 where the CPU 131 rotates the LF motor 66 in the counterclockwise direction by the predetermined amount at the same timing as step S112 as in the case of step S20. After the drive control of step S122 is finished, the CPU 131 waits 200 ms (step S123). Then, the CPU 131 judges whether the ASF motor control is finished as in the case of step S14.

If it is judged that the motor control is finished in step S113 or S123, the count C is incremented. In step S131, the CPU 131 judges whether the count C is equal to a predetermined count n. If the CPU 131 judges that that the count C is equal to n (C=n), the motor control process terminates. On the other hand, if the CPU 131 judges that the count C is not equal to n (C≠n), the ASF motor control (steps S110-S113) and the LF motor control (steps S120-S124) are executed again.

(Second Variation)

As a second variation of the motor control process and timing chart, FIG. 13 illustrates a flowchart of a motor control process, and FIG. 14 illustrates timing chart of control of motors. The motor control process is executed when the input lever 74 is moved from the third drive transmission position P3 to the first drive transmission position P1. In the following, explanations of steps which are substantially the same as those of FIG. 9 will not be repeated for the sake of simplicity.

When the count C is reset in step S201, ASF motor control in steps S210 to S211 and LF motor control in steps S220 to S221 are executed concurrently. Although FIG. 13 is illustrated such that the control flow is branched from step S201 to steps S210 and S220 for convenience of explanation, actually the ASF motor control and the LF motor control are executed as separate processes.

In the ASF motor control process (steps S210 to S211), the ASF motor 65 is rotated by a predetermined rotation amount in the clockwise direction. First, in step S210, the same step as step S10 in FIG. 9 is executed. After the drive control in step S210 is finished, the CPU 131 waits 200 ms (step S211). After the waiting time of 200 ms has elapsed, the CPU 131 sets the end flag of the ASF motor control, and control proceeds to step S212. In step S212, the CPU 131 judges whether the LF motor control is finished as in the case of step S14 in FIG. 9.

In the LF motor control process in steps S220 to S221, the LF motor 66 is rotated by a predetermined rotation amount in the clockwise direction. First, in step S220, the same step as step S20 in FIG. 9 is executed. After the drive control in step S220 is finished, the CPU 131 waits 200 ms (step S221). After the waiting time of 200 ms has elapsed, the CPU 131 sets the end flag of the LF motor control. Then, control proceeds to step S222. In step S222, the same step as step S22 in FIG. 9 is executed. That is, in step S222, the CPU 131 judges whether the ASF motor control is finished.

If it is judged that the motor control is finished in step S212 or S222, the count C is incremented. In step S231, the CPU 131 judges whether the count C is equal to a predetermined count n. If the CPU 131 judges that that the count C is equal to n (C=n), the motor control process terminates. On the other hand, if the CPU 131 judges that the count C is not equal to n (C≠n), the ASF motor control (steps S210-S211) and the LF motor control (steps S220-S221) are executed again.

(Third Variation)

As a third variation of the motor control process and timing chart, FIG. 15 illustrates a flowchart of a motor control process, and FIG. 16 illustrates timing chart of control of motors. The motor control process is executed when the input lever 74 is moved from the third drive transmission position P3 to the first drive transmission position P1. In the following, explanations of steps which are substantially the same as those of FIG. 9 will not be repeated for the sake of simplicity.

When the count C is reset in step S301, ASF motor control in steps S310 to S314 and LF motor control in steps S320 to S324 are executed concurrently. Although FIG. 15 is illustrated such that the control flow is branched from step S301 to steps S310 and S320 for convenience of explanation, actually the ASF motor control and the LF motor control are executed as separate processes.

As shown in the upper timing chart in FIG. 16, in the ASF motor control process (steps S310 to S314), the ASF motor 65 is rotated by a predetermined rotation amount in the clockwise direction, and is rotated by a predetermined rotation amount in the counterclockwise direction, and thereafter is stopped. First, in step S310, the CPU 131 rotates the ASF motor 65 by the predetermined amount in the clockwise direction as in the case of S10 in FIG. 9. After the drive control in step S310 is finished, the CPU 131 waits 200 ms (step S311). After the waiting time of 200 ms has elapsed, the CPU 131 judges whether the first waiting time of the LF motor control has elapsed as in the case of step S111 in FIG. 11. If the waiting time has elapsed, the CPU 131 rotates the ASF motor 65 by the predetermined amount in the counterclockwise direction at the same timing as steps S323 as in the case of step S12 in FIG. 9 (step S313). After the drive control in step S313 is finished, the CPU 131 waits 200 ms (step S314). After the waiting time of 200 ms has elapsed, the CPU 131 judges whether the LF motor control is finished as in the case of step S14 in FIG. 9 (step S315).

As shown in the lower timing chart in FIG. 16, in the LF motor control process (steps S320 to S324), the LF motor 66 is rotated by a predetermined rotation amount in the clockwise direction, and is rotated by a predetermined rotation amount in the counterclockwise direction, and thereafter is stopped. First, in step S320, the CPU 131 rotates the LF motor 66 by the predetermined amount in the clockwise direction as in the case of S10 in FIG. 9. After the drive control in step S320 is finished, the CPU 131 waits 200 ms (step S321). After the waiting time of 200 ms has elapsed, the CPU 131 judges whether the first waiting time of the ASF motor control has elapsed as in the case of step S121 in FIG. 11. If the waiting time has elapsed, the CPU 131 rotates the LF motor 66 by the predetermined amount in the counterclockwise direction at the same timing as step S313 as in the case of step S122 in FIG. 11 (step S323). After the drive control in step S323 is finished, the CPU 131 waits 200 ms (step S324). After the waiting time of 200 ms has elapsed, the CPU 131 judges whether the ASF motor control is finished as in the case of step S22 in FIG. 9 (step S325).

If it is judged that the motor control is finished in step S315 or S325, the count C is incremented in step S330. In step S331, the CPU 131 judges whether the count C is equal to a predetermined count n. If the CPU 131 judges that that the count C is equal to n (C=n), the motor control process terminates. On the other hand, if the CPU 131 judges that the count C is not equal to n (C≠n), the ASF motor control (steps S310-S314) and the LF motor control (steps S320-S324) are executed again.

(Fourth Variation)

As a fourth variation of the motor control process and timing chart, FIGS. 17A and 17B illustrate parts of flowcharts of the motor control process.

There is a possibility that even if the driving signal is supplied to the motor 65 or 66, the motor 65 or 66 does not rotate due to a load caused by the surface pressure between gears or an unexpected torque. There is also a possibility that due to the surface pressure or the unexpected torque, the rotation amount of the motor 65 or 66 gets lower than a predetermined rotation amount. Inversely, the rotation amount of the motor 65 or 66 might get larger than or equal to the predetermined rotation amount due to an excessively light load. Because both of the rotation amount larger than or equal to the predetermined rotation amount and the rotation amount smaller than the predetermined rotation amount is the abnormal condition for the ASF motor control and the LF motor control. Therefore, if the drive control is executed in such an abnormal condition, it is undesirable to count the number of times of drive control.

In the fourth variation, when it is judged that the motor control is finished in step S14 or S22 in FIG. 9, the CPU 131 judges whether an abnormal driving condition occurs during the ASF motor control or the LF motor control (step S6). The judgment in step S6 may be made based on the number of pulses from the rotary encoder 81 or 82. For example, if the number of pulses corresponding to the predetermined rotation amount is not detected within a predetermined time range, the CPU 131 may judge that the abnormal driving condition occurs.

If the CPU 131 judges that the abnormal driving condition occurs, the CPU 131 may execute the judgment in step S31 without incrementing the count C. On the other hand, if the abnormal condition does not occur, the count C is incremented in step S30. Since the number of times of motor control is not counted when the abnormal drive condition occurs, the motor control is properly executed for the predetermined number of times larger than or equal to the predetermined number n. As shown in FIG. 17B, when it is judged that the abnormal drive condition occurs, control may proceed to step S1 in FIG. 9 to reset the counter C.

Although the present invention has been described in considerable detail with reference to certain preferred embodiments thereof, other embodiments are possible.

What is claimed is:

1. An image recording device, comprising:

a first motor configured to be able to rotate in a first rotational direction and a second rotational direction different from the first rotational direction;

a second motor configured to be able to rotate in the first rotational direction and the second rotational direction;

a first switch gear that is rotated by receiving a driving force from the first motor;

a second switch gear that is rotated by receiving a driving force from the second motor and is supported coaxially with respect to the first switch gear;

a first transmission gear that is located to be able to engage with the first switch gear and transmits a driving force to a first driving unit; and a second transmission gear that is located to be able to engage with the second switch gear and transmits a driving force to a second driving unit, the first switch gear and the second switch gear being provided to engage with corresponding ones of the first transmission gear and the second transmission gear in accordance with movement of the first and second switch gears in an axial direction, the image recording device further comprising:

a control unit configured such that when the first switch gear and the second switch gear are moved in the axial direction, the control unit rotates one of the first and second motors by a first predetermined rotation amount, and starts the other of the first and second motors while the one of the first and second motors is rotated, wherein the control unit rotates the other of the first and second motors by a second predetermined rotation amount.

2. The image recording device according to claim 1, wherein the controller starts the first and second motors at a same time so as to rotate the first and second motors at same timing.

3. The image recording device according to claim 1, wherein the control unit executes:

first control in which the first motor is rotated in one of the first and second rotational directions by a first amount, and is stopped after the first motor is rotated in the one of the first and second rotational directions by the first amount; and second control in which the second motor is rotated in the first rotational direction by a second amount, is rotated in the second rotational direction by the second amount, and is stopped after the second motor is rotated in the second rotational direction by the second amount, wherein the second control is executed while the first control is executed.

4. The image recording device according to claim 3, wherein the control unit executes the first control and the second control such that the first control and the second control are terminated substantially at a same time.

5. The image recording device according to claim 3, wherein the control unit is configured such that after the first control and the second control are finished, the control unit repeats the first control and the second control a predetermined number of times.

6. The image recording device according to claim 1, wherein the control unit executes:

third control in which the first motor is rotated in one of the first and second rotational directions by a third amount, and is stopped after the first motor is rotated in the one of the first and second rotational directions by the third amount; and fourth control in which the second motor is rotated in one of a same direction and an inverse direction with respect to a rotational direction of the first motor by a fourth amount, and is stopped after the second motor is rotated by the fourth amount, wherein the fourth control is executed while the third control is executed.

7. The image recording device according to claim 6, wherein the control unit is configured such that after the third control and the fourth control are finished, the control unit repeats the third control and the fourth control a predetermined number of times.

8. The image recording device according to claim 1, further comprising:

a carriage on which a recording head is mounted, the carriage being configured to be reciprocated in a predetermined direction;

a positioning member that is provided to be slidable in the predetermined direction of a reciprocation motion of the carriage to change positions of the first and second switch gears in the axial direction and thereby to position the first switch gear to be able to engage with the first transmission gear and the second switch gear to be able to engage with the second transmission gear, the positioning member being configured to slide when the carriage contacts the positioning member; and an elastic member that elastically presses the positioning member in a certain direction along the predetermined direction of the reciprocation motion of the carriage.

* * * * *